US006959764B2

(12) United States Patent
Preston

(10) Patent No.: US 6,959,764 B2
(45) Date of Patent: Nov. 1, 2005

(54) BAFFLE SYSTEM FOR TWO-PHASE ANNULAR FLOW

(76) Inventor: Yale Matthew Preston, 68 Upper Clear Creek Rd., Buffalo, WY (US) 82834

( * ) Notice: Subject to any disclaimer, the term of this patent is extended or adjusted under 35 U.S.C. 154(b) by 0 days.

(21) Appl. No.: 10/455,562

(22) Filed: Jun. 5, 2003

(65) Prior Publication Data

US 2004/0244988 A1 Dec. 9, 2004

(51) Int. Cl.[7] ..... E21B 43/00
(52) U.S. Cl. ..... 166/265; 166/105.5; 166/372
(58) Field of Search ..... 166/265, 105.5, 166/369, 372; 299/8

(56) References Cited

U.S. PATENT DOCUMENTS

| | | | | |
|---|---|---|---|---|
| 6,382,321 | B1 | 5/2002 | Bates et al. | 166/372 |
| 6,533,033 | B2 | 3/2003 | Skillman | 166/105.1 |
| 6,755,250 | B2 * | 6/2004 | Hall et al. | 166/265 |
| 2003/0047310 | A1 * | 3/2003 | Thomas et al. | 166/265 |

OTHER PUBLICATIONS

Oil Well Diagnosis by Sensing Terminal Characteristics of the Induction Motor, IEEE Transactions on Industrial Electronics, vol. 47, No. 5, Oct. 2000, pp. 1100–1107.
Black Diamond Energy Coalbed Methane, http://www-.blackdiamondenergy.com/coalbed.html, May 14, 2003, pp. 1–4.

* cited by examiner

*Primary Examiner*—William Neuder
(74) *Attorney, Agent, or Firm*—Pate Pierce & Baird

(57) ABSTRACT

An apparatus for promoting the flow of methane gas from a coal bed methane well. The apparatus may include a well casing extending into the earth to a cool seam aquifer. A conduit may be placed within the well and extend from the coal seam aquifer to the earth's surface. A pump may be connected to pump water from the coal seam aquifer through the conduit to the surface. A baffle may be placed in the gap formed between the interior surface of the well casing and the exterior surface of the conduit to the preferentially permit the flow of gas over the flow of water therethrough. The baffle may mitigate well bore pressure fluctuations, thus reducing the occurrence of pump gas lock and reducing well bore damage.

36 Claims, 18 Drawing Sheets

BAFFLE SYSTEM FOR TWO-PHASE ANNULAR FLOW

BACKGROUND

1. The Field of the Invention

This invention relates to regulating two-phase flow and, more particularly, to novel systems and methods for optimizing production from wells such as those found in oil, gas, and coal bed methane fields.

2. The Background Art

The presence of methane ($CH_4$, a principal ingredient of natural gas) in underground coal seams has long been known. In the past, coal bed methane was vented to provide a non-explosive, non-suffocating environment in which coal miners could work. However, in recent times, methane has become a popular fuel for use in electric generators, furnaces, city buses, and the like. Methane's popularity may largely be attributed to its relatively low cost and clean combustion characteristics. Meanwhile, conventional oil drilling and production is ongoing for petroleum and natural gas.

Various techniques are used to collect coal bed methane. In recent development, water well technology is used to collect methane from coal seam aquifers. By drilling down to a coal seam aquifer and pumping out water, the pressure holding the methane within the coal seam is relieved somewhat as it propels methane and water mixed therewith up the well bore (typically a cased bore). The methane may then be gathered, compressed, and shipped to customers. Well drilling and production techniques permit the collection of methane from coal seams at virtually all depths at which coal is available. Thus, coal bed methane may be collected from coal seams that are far too deep to be mined themselves.

Unfortunately, the best producing coal bed methane wells are generally the most difficult to control and maintain. High production coal bed methane wells have a high occurrence of "gas lock." Gas lock occurs when a pump lifting water from a coal seam aquifer ingests gas (i.e. methane), rather than water. Such pumps are typically electrically driven, submersible types, often with centrifugal impellers, and thus having non-positive-displacement. Often it is difficult for a pump to rid itself of the gas once ingested. Thus, the ingested gas is trapped inside the pump. The pump's impellers are ineffectual to move the gas out and water cannot get to the impellers.

Gas locked pumps are undesirable for two reasons. First, a gas locking occurs, a pump is initially less efficient at lifting water, and performance quickly decays until the pump lifts no water. As a result, water enters the well from the coal seam aquifer at a rate greater than the pump can extract it. Thus, the well tends to fill with water. High water levels increase the pressure head on the well and less methane is able to escape. The water output and related methane production of the well are greatly reduced, and in some cases are even stopped entirely.

The second problem is that gas locked pumps age quickly. The decrease in water flow through the pump results in a substantial decrease in lubrication and cooling and is associated with and responsible for increased water in mechanical components. Electrical insulation and windings in pump motors can melt down from overheating. Moreover, a pump operating at a comparatively elevated temperature tends to accumulate mineral deposits at a faster rate. Thus, a pump in gas locking situation is much more likely to seize, damaging the pump and motor. Once a pump fails, it must be pulled from the well and a new pump and motor lowered back in. However, the new pump may be just as susceptible to gas lock as the failed pump. Thus, the costly cycle may continue.

Various devices have been applied to solve the gas lock/gas ingestion problem. For example, progressive cavity pumps (helical augers with positive displacement) have been installed in problematic wells. Progressive cavity pumps are much more expensive to purchase and maintain than centrifugal pumps. However, progressive cavity pumps are better able to ingest gas without losing pumping ability. Ingested gas is expelled from the pump along with everything else ingested. Thus, progressive cavity pumps do not gas lock, technically speaking.

That is not to say, however, the repeated ingestion of gas creates no problems in progressive cavity pumps. Without a steady flow of water, progressive cavity pumps may be insufficiently lubricated and cooled. Thus, ingesting gas shortens the life of progressive cavity pumps much as it does the life of centrifugal pumps. In addition, such pumps have rotors operating between stators covered with elastomeric and other polymeric compounds, which materials may fail due to hysteresis. Hysteresis may be thought of as a failure to return elastically to a neutral (initial unstressed) mechanical position. This may sometimes result from inelastic creep, yielding (plasticity), melting, or the like.

Other devices have been introduced to prevent submersible pumps from ingesting gas. For example, shrouds or "gas jackets" have been used. Gas jackets operate on the assumption that gas bubbles in coal bed methane wells will rise. Under this theory, submersible pumps gas lock by inhaling gas bubbles rising past the pump inlet. Typical gas jackets are designed to create a path wherein all fluids must travel downward a selected distance before they may enter the pump inlet. The operational concept is that since gas bubbles will rise, they will not be able to maintain a downward direction all the way down to the inlet. Gas jackets appear to prevent gas lock in some wells, but perform only marginally. Moreover, gas jackets are completely ineffective in many other wells. Gas jackets may be based on a false premise, that gas bubbles always rise sufficiently fast in moving liquid. Two phase flows may actually carry large amounts of entrained gases in a liquid "matrix," or large amounts of liquid in a gas environment. Flows may be up, down, or horizontal, including combinations thereof.

As a practical matter, gas locking appears to result from collection of upwardly moving gas, but just as often results from collection of downwardly flowing gas entrained in water moving down toward a pump inlet. Thus, gas jackets have not proven predictable or reliable. Moreover, some gas jackets prevent water from accessing and cooling all parts of the pump motor, resulting in poor cooling flows, resultant overheating, and its attendant consequences, including catastrophic failure.

Other devices, operating on this same assumption, that gas bubbles in coal bed methane wells generally rise, have been used. One such device employs a "stinger," a narrow extension of a shroud extending down below the actual pump inlet to the very lowest point reasonably possible within the well. Theoretically, the lowest point should have the lowest concentration of gas bubbles. The stinger designs may solve the problems of overheating associate with some gas jackets (shrouds) in that water entering the stinger passes over and cools the motor before entering the stages of the pump. However, like other gas jackets and shrouds, these devices prevent gas lock in certain wells, but not all, and not predictably, reliably, or permanently.

Moreover, all such shrouds and gas jackets do not change the fact that a pump inlet is a relative low pressure region to which flows proceed, entraining gas in liquid (water). Conventional oil wells may likewise entrain gases in liquids (petroleum). Some theorize that a certain amount of non-condensible methane will nevertheless be absorbed, and may come out of solution under reduced pressure (pressure less than that at which the gas is absorbed in an equilibrium concentration). At a reduced pressure, the equilibrium concentration of gas changes, releasing gas. Under this theory, the question of gas locking may simply be an issue of flow rate, absorption and desorption rates of gas in water, accumulation, and the pressure differential imposed by the pump inlet in operation. The gas can bubble out of solution as carbon dioxide does from warm or non-pressured soda. By whatever mode, gas for gas locking seems to remain available to interfere with proper pump operation.

What is needed is a simple device and associated method to regulate and control the flow of gas and water in coal bed methane wells, as well as conventional oil wells so that optimum water and other liquid extraction, and thus total methane or oil production, may be maintained.

BRIEF SUMMARY OF THE INVENTION

The present invention is directed to apparatus and methods for mitigating well bore anomalies that may inhibit proper operation of production equipment. For example, pressure fluctuations may be reduced, thus reducing the occurrence of pump gas lock and reducing well bore damage caused by extreme pressure differentials across the comparatively soft structure of a coal seam. An apparatus made in accordance with one embodiment of the invention may include a well casing extending into the earth with an inlet positioned at a coal seam aquifer and an outlet positioned at the earth's surface. A well bore may be formed directly below the inlet of the well casing. Usually, a well bore is drilled into a coal seam aquifer, an may be partially or completely cased. If a bore is cased only to the top of the seam, then a substantially larger bore diameter (under ream) is typically cut below the cased bore for increasing available surface area for flow into the bore and to the pump. This under reamed region also acts as a cistern or collection location to buffer the flow of methane and water toward the pump and casing. As a practical matter, the under reamed region provides some amount of time in which gas may separate from water, for better or worse.

A water extraction condition may extend down within the casing. The water extraction conduit may have an intake positioned at the coal seam aquifer and an exit positioned at the surface. A pump may be operably connected to the inlet of the water extraction conduit. The water extraction conduit may be used to suspend the pump within the well bore. In operation, the pump removes water from the well bore. The removal of water creates a zone having a lower pressure that the rest of the coal seam. Water and gas within the coal seam may then migrate from the coal seam aquifer to the lower pressure well bore.

In the coal seam and in the well bore, the methane may exist as bubbles of various sizes that propagate along a direction of motion. In the coal seam, water flow moves with the gas toward the bore. In view of the nature of surface tension forces, water apparently encases and drives bubbles of gas through the interstices of a coal seam as both flow toward the bore. Upon rising in the bore, the bubbles may grow or agglomerate as they pass up a gas flow path (i.e. the gap, conduit, or annulus formed by the interior of the well casing and the exterior of the water extraction conduit). When the methane reaches the surface of the earth, it may be gathered, compressed, and distributed to customers. Problems may occur in certain high gas and water producing coal bed methane wells. The high volumes of gas flow within a well bore may entrain water, which may fall, rise, froth, and eventually agglomerate into slugs of water traveling up (and sometimes down) the gas flow path. Water may form a water column having some relative proportion of gas and water therein. Water columns are dynamic, rising and falling. As a practical matter, a water column produces a pressure reflecting the total weight of the column above any datum point, regardless of the actual distribution of water and gas, or the actual vertical extent of such a two-phase mixture.

A water column manifests its presence by increasing the pressure on the well bore. Due to the dynamic nature of the ascending and descending of various slugs of water within the gas flow path, the pressure in the well bore may vary. High pressures within the well bore generate a significant impetus for gas bubbles in the well bore to find a location of lower pressure. Typically, the location of lowest pressure within the well bore is the pump inlet. Thus, a dynamic and heavy water column, trapping a large bubble of gas therebelow, subjects the bubble to a comparatively high pressure. This may increase the chance of that bubble reaching the pump and the pump ingesting gas to become gas locked.

A baffle placed within the gas flow path may mitigate the pressure dynamics caused by water slugs within the gas flow path. The baffle may also lower the well bore pressure by precluding the formation of a significant water column. A baffle may operate by preferentially permitting the flow of gas over the flow of water therethrough. The drag on water is higher than the drag on gas. Thus, gas may flow up the gas flow path while water tends to stay in the well bore where it may be efficiently pumped to surface. A baffle in accordance with the present invention may distinguish between the flow of gas and the flow of water based on the respective viscosities, densities, and inertia of gas and water.

A baffle in accordance with the present invention may have any suitable shape or configuration. To a large degree, the shape of a baffle system may be determined by the shape of the gas flow path to be regulated. If the gas flow path is annular, then the baffle may have any annular shape. Suitable baffle configurations may include a plate having apertures therethrough, a series of plates having apertures therethrough, a porous mass, vanes or the like operating as a vortex flow generator, and the like. A baffle may be formed of any suitable material.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the systems and methods of the present invention, as represented in FIGS. 1 through 27, is not intended to limit the scope of the invention, as claimed, but is merely representative of the certain selected embodiments of the invention. The presently disclosed embodiments of the invention will be best understood by reference to the drawings, wherein like parts are designated by like numerals throughout.

Figure 1:
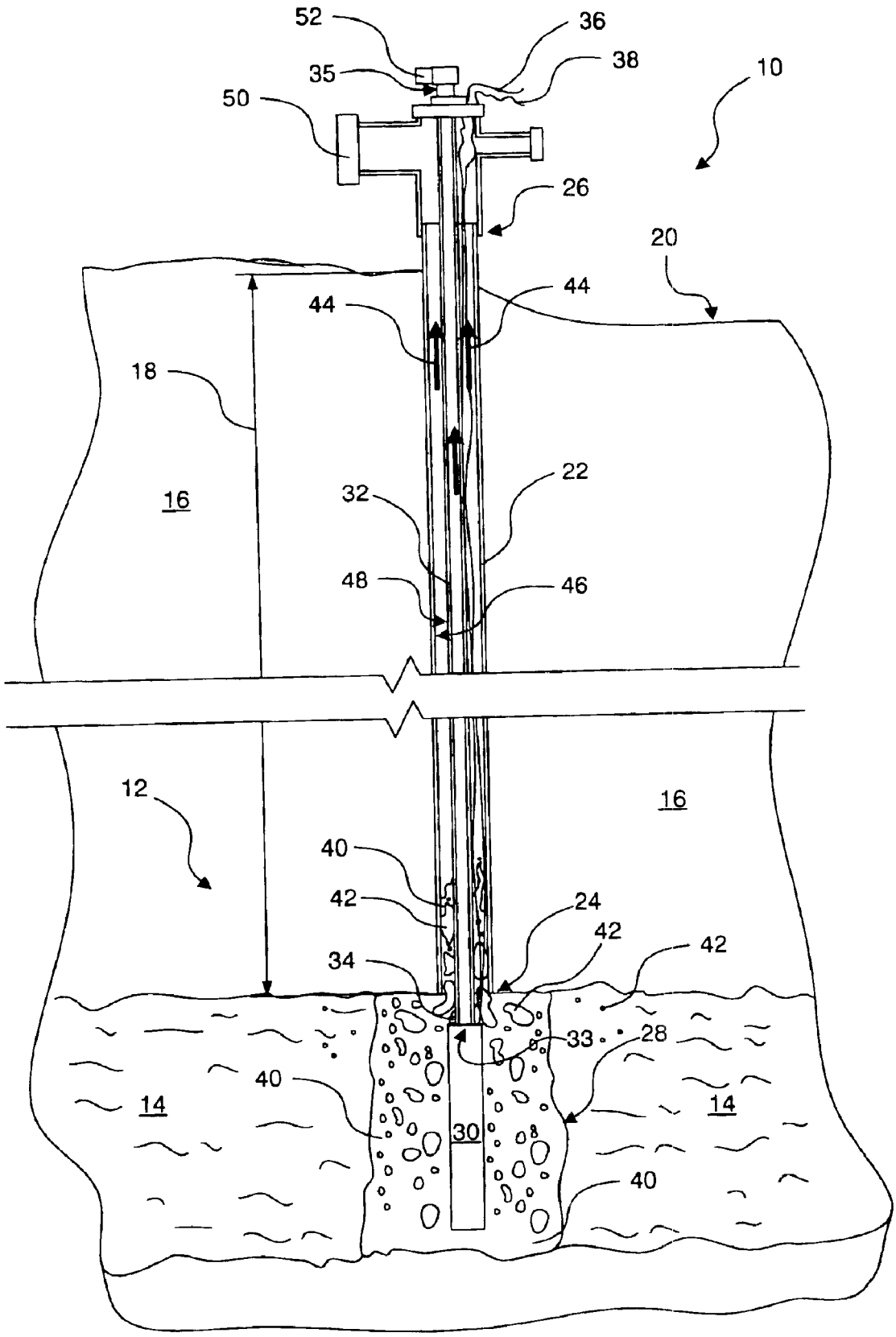
FIG. 1 is cross-sectional side elevation view of a coal bed methane well.

FIG. 1 illustrates a coal bed methane well 10 for extraction of methane (hereinafter gas). In describing the present invention, a coal bed methane well 10 will be used as an example of how the present invention, to be described in detail hereinbelow, may be applied. Those of skill in the art will recognize that the present invention may be applied with minimal adaptions to conventional oil well pumping situations with similarly beneficial results. As a practical matter, the present invention may be applied to any well handling two-phase flow in which separation between a gas and a liquid may be requisite or beneficial. Specifically, the present invention may be applied to oil wells to assist in separating oil and methane or other entrained gases.

A coal bed methane well 10 provides access to a geological formation 12 of a coal seam 14 buried under a significant amount of overburden 16. The depth of overburden 18 covering a coal seam 14 may be anywhere from a few tens to thousands of feet. Typically depths of overburden 18 range from 400–3000 feet.

Coal bed methane wells 10 may be formed using water well technology to drill a bore (hole) from the earth's surface 20 to the coal seam 14. Once the bore is drilled, a well casing 22 may be inserted and sealed to provide a closed, stable flow path from an inlet 24 at the coal seam 14 to an outlet 26 at the surface 20. With the well casing 22 in place, bore reaming equipment may be lowered into the well 10 to cut a larger well bore 28 directly below the inlet 24. The oversized well bore 28 may be cut to extend partially into, or completely through, the coal seam 14.

In certain applications, a well casing 22, rather than stopping at or near the top of a coal seam 14, may extend into or through a coal seam 14. The well casing 22 may then be perforated to provide fluid communication from the coal seam 14 to the interior of the well casing 22.

Coal seams 14 are typically aquifers. Often, the water within a coal seam aquifer 14 acts as a stopper, resisting the escape of gas. Thus, to permit gas entrained within the coal seam 14 to escape up the well 10, the water pressure within the well 10 must be lowered. This process is known as de-watering a well 10. De-watering is accomplished by pumping water from the well bore 28. Depending on the flow of water within a coal seam aquifer 14, de-watering may take as many as 18–24 months. Actually, water may move the gas through the coal formation, and thus be a required motive means for gas extraction. By whatever mode, extracting water extracts gas.

A submersible pump 30 may be secured to a water extraction conduit 32 and lowered into the well 10. The submersible pump 30 may be operably connected to force water into an intake 33 positioned at the coal seam aquifer 14, through the water traction conduit 32, and out an exit 35 located at the surface 20. If desired, various instruments may be lowered into the well 10 or secured to the pump 30 and/or the water extraction conduit 32 before they are lowered into the well 10. For example, in certain situations, it may be advantageous to have pressure readings from at or near the under-ream well bore 28. Thus, a pressure transducer 34 may be secured at or near the pump 30 before it is lowered into the well 10. Power transmission lines 36 and instrument wires 38 may extend from the pump 30 and/or pressure transducer 34 to the surface 20 as needed.

In general, de-watering does not, and is not intended to, rid a coal seam 14 of water. Indeed, removing too much water may be harmful if not fatal to methane production. The flow of water to a well bore 28 and the flow of gas to a well bore 28 appear to depend directly on one another. That is, when the flow of water slows, so does the flow of gas. The intent of de-watering is to deplete the coal seam aquifer 14 sufficiently to lower the rate at which water enters a well bore 28. To be effective, the rate must be lowered to a volumetric flow that can be accommodated by the submersible pump. In that way, the pump may regulate the pressure of the well bore 28 to provide the ideal pressure for the escape of gas from the coal seam 14.

Once installed and operating, coal bed methane wells 10 extract both gas and water from the coal seam aquifer 14. Water 40 that collects in the well bore 28 is pumped up the water extraction conduit 32 to the surface 20. This removal of water 40 creates a general low pressure zone within the well bore 28. Due to the low pressure zone, water within the coal seam 14 migrates toward the well bore 28 through the various cracks, veins, and capillaries of the coal seam 14. As water moves through the coal seam 14 toward the well bore 28, it may in effect rinse the coal seam 14 of gas. That is, the water may carry the gas with it, pushing the gas before it, or generate movement of the gas by some other mechanism.

As gas collects within the water, it may begin to conglomerate and form gas bubbles 42. As these bubbles 42 enter the well bore 28 they may continue to conglomerate or agglomerate to form larger bubbles 42. Since gas is less dense than water 40, the gas bubbles 42 may tend to rise within the well bore 28. If functioning properly, the bubbles 42 may then escape the water 40 and travel up a gas flow path 44 to the surface 20. The gas flow path 44 may be defined as the gap, conduit, or annulus formed by the interior surface 46 of the well casing 22 and the exterior surface 48 of the water extraction conduit 32.

At the surface 20, the fluids 40, 42 traveling in the gas flow path 44 and the water extraction conduit 32 may diverge. The gas 42 in the gas flow path 44 may be diverted through a methane take-off 50 to be collected, compressed, and shipped to customers. The water 40 pumped up the water extraction conduit 32 may be diverted to a water take-off 52 where it may be pumped to a reservoir, used for irrigation, used to water livestock, discarded, or treated and pumped back into an aquifer.

Figure 2:
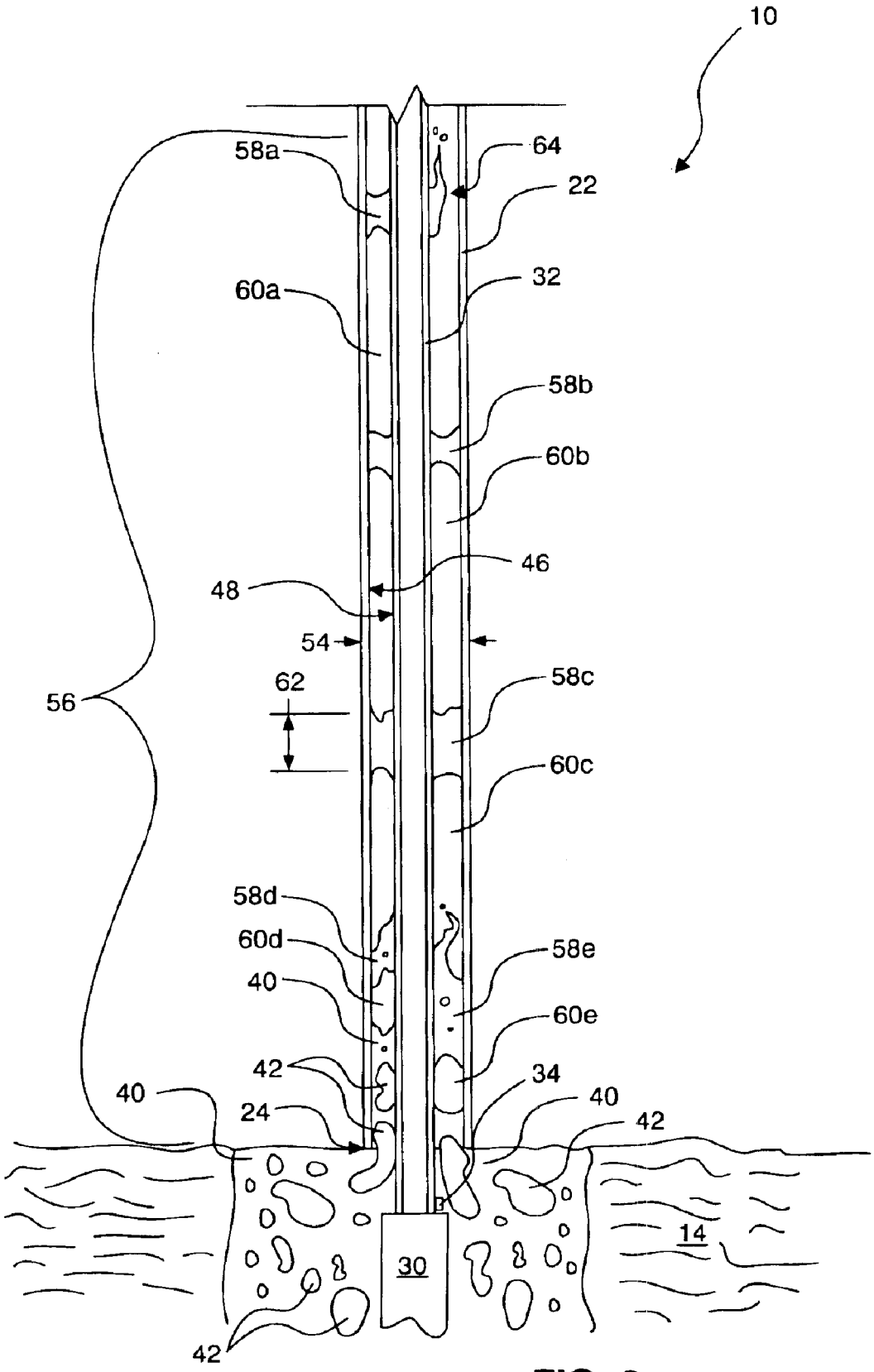
FIG. 2 is partial, cross-sectional side elevation view of a coal bed methane well illustrating the formation of a water column comprising water slugs and other phenomena tending to increase well bore pressures.

Referring to FIG. 2, coal bed methane wells 10 are typically drilled and cased to a relatively standard diameter 54. However, different coal seam aquifers 14 produce water 40 and/or gas 42 at different rates. Thus, casings 22 and conduits 32 of relatively standard size must accommodate the whole range of volumetric flows generated by coal bed methane wells 10. The standard well diameters 54 may be sufficient for some coal seam aquifers 14 or wells 10, must inadequate for other, high volume producing, coal seam aquifers 14 or wells 10. Generally, the coal seam aquifers 14 that provide the largest amounts of gas 42, and therefore, the most profitable producers, are also the most difficult to control and maintain.

Due to the internal pressure of coal seams 14, coal bed methane wells 10 often develop a water column 56. A water column 56 may be defined as a measure of the water 40 in the gas flow path 44. A water column 56 may be measured in terms of pressure head. Thus, a particular water column 56 may be described as five feet, fifty feet, or the like. The pressure head of the water column 56 may be measured by a pressure transducer 34 placed near the inlet 24 of the well casing 22.

Coal bed methane wells 10 no longer having water extracted, typically develop a static water column 56. The water column 56 grows until it generates a pressure head equal to the natural pressure of the coal seam aquifer 14.

A water column 56 is not always a homogenous stack of water 40. When a coal bed methane well 10 is in operation, the water column 56 can be very dynamic. Often, water columns 56 on active wells 10 are a collection of water slugs 58 or pockets 58 separated by gas pockets 60. The various water slugs 58 are included in the measurement of the water column 56 so long as their weight is supported from below. The head above a pump 30 may be caused by a nearly homogeneous froth or by coherent slugs 58 of water and pockets 60 of gas.

For example, a water slug 58*c* may form an annulus and fill a selected length 62 of the gas flow path 44. This sealing or bridging effect may be facilitated by the relatively small dimension involved and the natural surface tension of water 40. Since the gas pocket 60*c* is contained by the water slug 58*c*, it must support the weigh to the water slug 58*c*. Thus, the weight of the various water slugs 58 may be communicated and summed down along the gas flow path 44.

On occasion, a water slug of 58*a* being supported by a pocket of gas 60*a* may destabilize 64. When this happens, the supporting gas pocket 60*a* may blow-by 64 the water slug 58*a*. The gas pocket 60*a* may then continue up the gas flow path 44. The water slug 58*a*, on the other hand, is no longer supported in its location and falls back down the gas flow path 44. In falling, a water slug 58*a* may collide with and join another water slug 58*b*. The resulting water slug 58 may then stabilize or destabilize, and the cycle continues.

Water slugs 58 and gas pockets 60 move up and down within the gas flow path 44 based on pressure differentials. If the pressure generated by the portion of the water column 56 above a water slug 58 is greater than the pressure of the supporting gas pocket 60 the water slug 58 will descend. If, on the other hand, the pressure exerted by a supporting gas pocket 60 under the influence of gravity is greater than the pressure generated by the portion of the water column 56 above a water slug 58, the water slug will ascend.

Water slugs 58 may be generated when large bubbles of gas 40 collide and form gas pockets 60. As these large gas pockets 60*d* enter the inlet 24 to the well casing 22, they may push a water slug 58*d* into the gas flow path 44 before them. As may be expected, higher gas 42 flows into a well bore 22 often lead to the formation of more of water slugs 58.

As water slugs 58 and gas pockets 60 travel up the gas flow path 44, they may continue to segregate. Water slugs 58*e* may collide with other water slugs 58*d* to create larger, complete, water slugs 58*c* capable of forming an annulus and sealing the gas flow path 44. Gas pockets 60*e* may collide with other gas pockets 60*d* to create larger, complete, gas pockets 60*c* capable of supporting the larger water slugs 58*c*.

The formation and destruction of water slugs 58 can be a very dynamic process. Blow-bys 64 and other destabilizations 64 may continuously destroy certain water slugs 58 only to enlarge others. Water slugs 58 may ascend rapidly within the flow path 44, descend rapidly within the flow path 44, or both, within a short period of time. On occasion, large water slugs 58 may descend as a piston and pressurize the gas 60 therebelow. Such a pressurization may cause the pressure within the well bore 28 to spike to levels well above the natural pressure of the coal seam 14. The end result is that the water column 56 may be very dynamic and may stop flows. This pattern may be seen in data received from pressure transducers 34 located near the inlet 24 to the well casing 22. Readings from such a transducer 34 may vary from two feet to fifty feet of head pressure in a matter of seconds.

Figure 3:
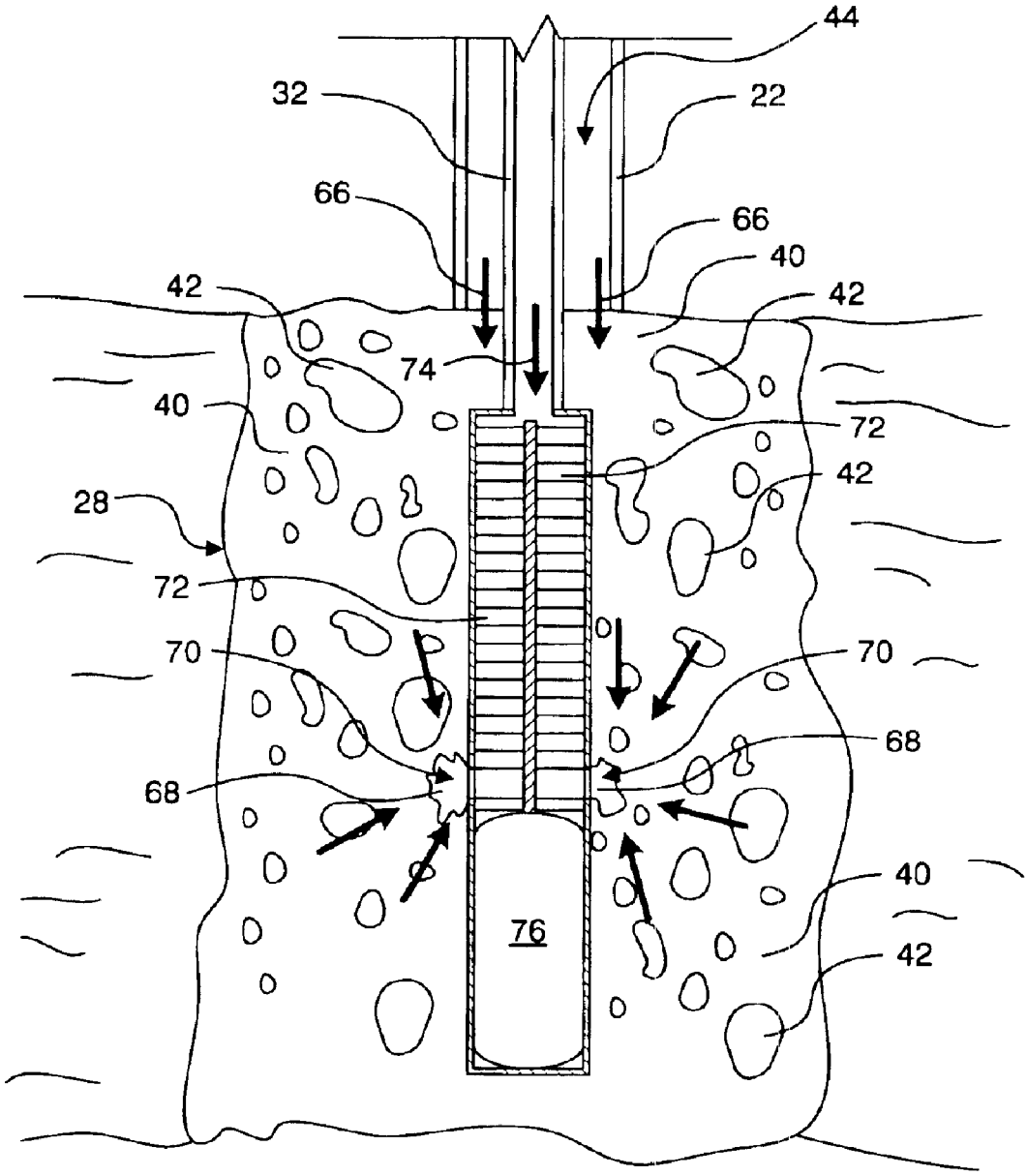
FIG. 3 is a cross-sectional side elevation view of a well bore illustrating the tendency of gas bubbles and pockets to migrate to the pump inlet when the well bore is sufficiently pressurized.

Referring to FIG. 3, "lifting costs" and "clean-out costs" make-up a considerable portion of the expense required to collect (produce and gather) coal bed methane. Lifting costs may be defined as any cost associated with lifting or extracting water from coal bed methane wells 10. Lifting costs may include capital costs of pumps 30 and maintenance, repair, or replacement costs. Clean out cost may be defined as any cost associated with removing coal particles and other materials introduced into the well 10 by the degradation of the well bore 28. The dynamic nature of the water column 56 in a coal bed methane wells 10 increases both the lifting cost and the clean-out costs associated with collecting coal bed methane.

When a well bore 28 is pressurized by the weight 66 of a water column 56, all fluids 40, 42 within the well bore 28 are motivated to seek the location of lowest pressure 68. While the motivation to seek the low pressure point 68 may always be present, at lower pressures, this motivation may be overcome by the buoyancy of gas bubbles 42. However, at elevated pressures, especially with a flow reversal due to a water column 56 dropping in the gas flow path 44, the motivation to seek the location of lowest pressure 68 may become greater in magnitude than the buoyancy force. Thus, gas bubbles 42 may travel downward within the well bore 28 to find the location of lowest pressure 68.

When a pump 30 is operating within the well bore 28, the location of lowest pressure 68 may be the pump inlet 70. Since gas bubbles 42 have a lower mass and viscosity than water 40, they may more easily migrate toward the pump inlet 70. Thus, during periods of high pressure in the well bore 28, it is more likely that the pump 30 may ingest gas 42 and gas lock.

Gas lock occurs when a submersible pump 30 lifting water from a coal seam aquifer 14 ingests gas 42, rather than water 40. Since many of the submersible pumps 30 used in coal bed methane wells are centrifugal, they are unable to rid themselves of the ingested gas 42. That is, centrifugal pumps 30 cannot positively displace the gas 42 and propel it through the various stages up the water extraction conduit 32. Moreover, the head 72 of the water 40 already in the water extraction conduit 32 prevents the ingested gas 42 from floating up through the pump 30. Thus, the ingested gas 42 is trapped inside the pump 30.

Gas locked pumps 30 are much less efficient at lifting water 40. The decrease in the flow of water 40 through the pump 30 may result in substantial deficiencies of lubrication and cooling. Wear on the pump 30 and the drive motor 74 is greatly increased. Moreover, a pump 30 operating at elevated temperature tends to attract mineral deposits at a faster rate. Thus, a pump 30 in gas lock is much more likely to seize, damaging the pump 30 and motor 74. Once a pump 30 fails, it must be pulled from the well 10 and a new pump 30 and motor 74 lowered back in. However, the new pump 30 may be just as susceptible to gas lock as the failed pump 30.

As a gas, methane is compressible. Thus, when a well bore 28 is pressurized by the weight 66 of a water column 56, the gas bubble 42 may tend to decrease in size. Conversely, when the pressure in the well bore 28 is lowered, the gas bubble 42 may tend to increase in size. This same contraction and expansion may occur when the gas bubbles 42 are still entrained in the coal seam 14 near the well bore 28, breaking up the coal structure. The broken coal pieces may then enter the well bore 28 to inhibit the flow of water 40 or gas 42 or disrupt the operation of the pump 30.

Figure 4:
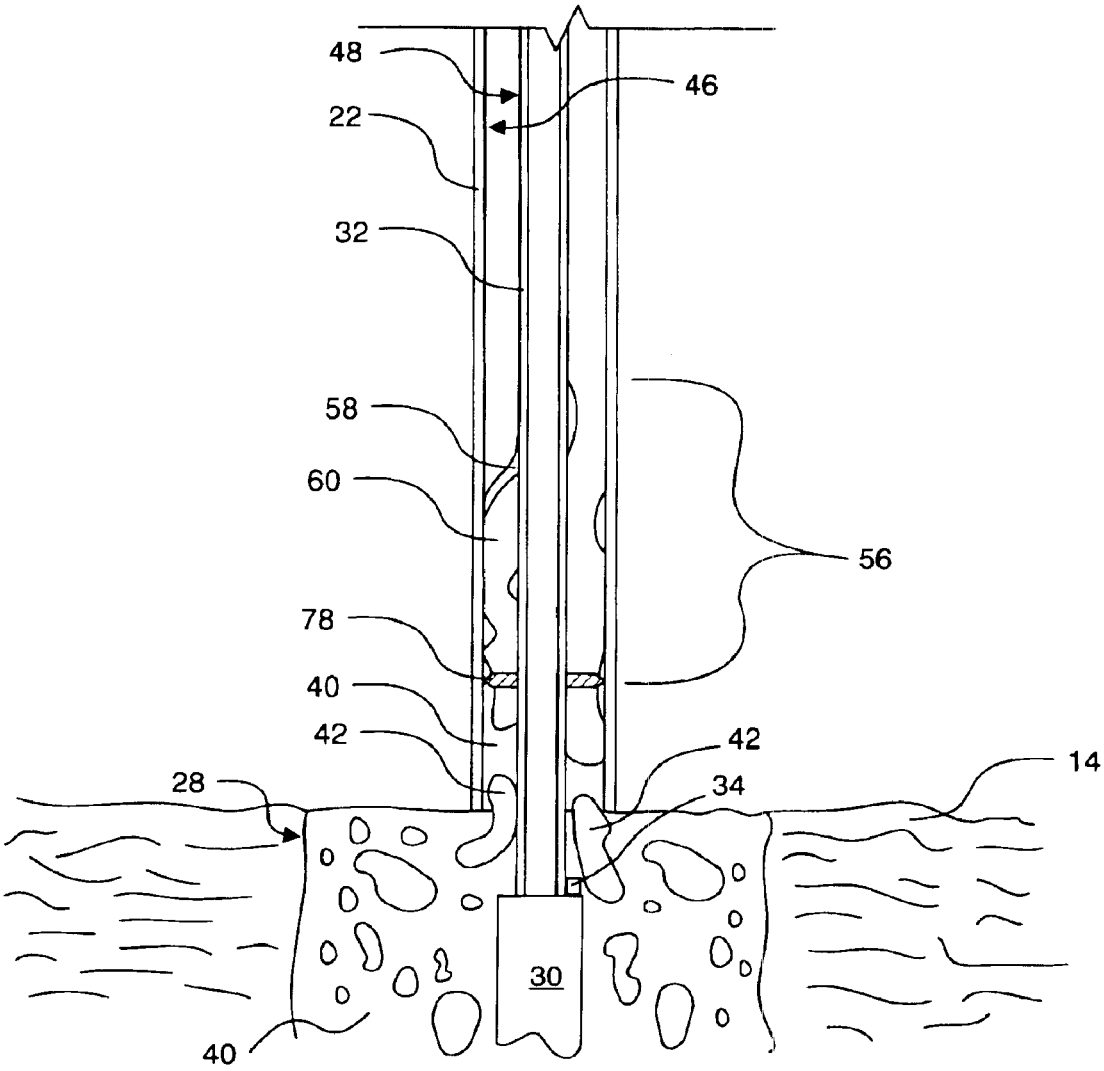
FIG. 4 is partial, cross-sectional side elevation view of a coal bed methane well illustrating a baffle in accordance with the present invention to resist the formation of a water column comprising water slugs and other phenomena tending to increase well bore pressures.

Referring to FIG. 4, a baffle 78 may be placed in the gas flow path 44. A baffle 78 in accordance with the present invention may be defined as any device that deflects, checks, or regulates flow to preferentially permit the flow of gas 42 over the flow of water 42 therethrough or thereby. A baffle 78 in accordance with the present invention may be formed of any suitable material. In certain embodiments, a baffle 78 may be formed from a material selected after consideration of toughness, strength, cost, formability, machineability, corrosion resistance, and the like. Suitable materials for a baffle 78 may include metals, metal alloys, polymers, reinforced polymers, wood, composites, and the like.

A baffle 78 may have any shape suitable to accomplish the desired regulation of flow. In certain embodiments, the shape of the baffle 78 may be selected to correspond to the shape of the gas flow path 44. That is, if the gas flow path 44 is annular, a baffle 78 may have a generally annular shape to effectively regulate the flow through the gas flow path 44. If the gas flow path 44 has a non-circular or irregular shape, a baffle 78 in accordance with the present invention may be shaped accordingly.

By preferentially permitting the flow of gas 42 over the flow of water 40 (or liquids, generally), a baffle 78 may increase the rate at which gas 42 enters the gas flow path 44 and decrease the rate at which water 40 enters the gas flow path 44. The reduction in admittance of water 40 may preclude or substantially limit the formation of water slugs 58. Thus, extreme pressure changes in the well bore 28 caused by the irregular flow of water slugs 58 within the gas flow path 44 may be reduced or eliminated. Moreover, since less water 40 can enter the gas flow path 44, the head or pressure applied by the weight 66 of the water column 56 to the well bore 28 may be substantially reduced.

By reducing pressure changes, as well as the maximum pressure experienced, in the well bore 28, the occurrence of gas lock or gas ingestion and deterioration of the well bore 28 may be substantially reduced or eliminated. Accordingly, extra expenditures for lifting costs and clean-out costs may be significantly reduced. Moreover, the stable, steady-state environment in a well bore 28 that is promoted by the baffle 78 facilitates optimization of the extraction of gas 42. That is, an operator may be able to better control and maintain desired parameters (i.e. water column pressure 66) to optimize gas 42 production.

In certain embodiments, the baffle 78 may act as a damper or shock absorber generating a pressure drop in all fluids 40, 42 passing therethrough or thereby in either direction. When acting as a damper or shock absorber, a baffle 78 may regulate flows ascending within the gas flow path 44 as well as flows descending in the flow path 44. The pressure drop may be proportional to the velocity of the fluid 40, 42. The baffle 78 may generate a larger pressure drop for the comparatively higher viscosity and density of water 40 than for gas 42 passing therethrough.

A baffle 78 in accordance with the present invention may distinguish between the flow of gas 42 and the flow of water 40 based on any respective characteristics, or combination of characteristic, of gas and water. For example, a baffle 78 may distinguish between the flow of gas and the flow of water based on the respective viscosities of gas and water. A baffle 78 may distinguish between the flow of gas and the flow of water based on the respective densities of gas and water. A baffle 78 may distinguish between the flow of gas and the flow of water based on the respective inertia of gas and water. In certain embodiments, a baffle 78 may distinguish between the flow of gas and the flow of water based on the respective viscosities, densities, and inertia of gas and water.

Figure 5:
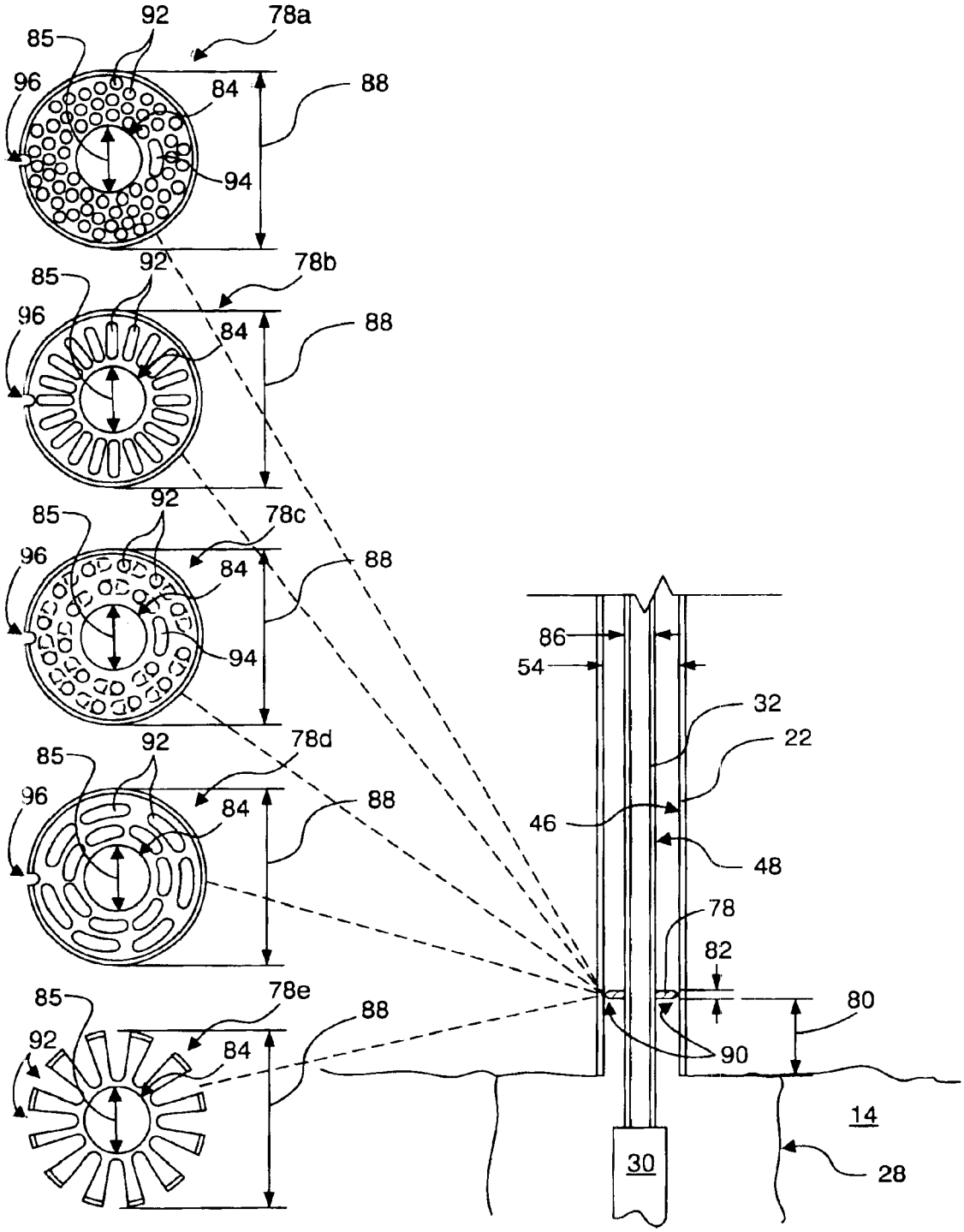
FIG. 5 is partial, cross-sectional side elevation view of a coal bed methane well illustrating various alternative embodiments of screen baffles in accordance with the present invention.

Referring to FIG. 5, a baffle 78 in accordance with the present invention may be placed at any suitable location in the gas flow path 44. In certain embodiments, a baffle 78 may be spaced a selected distance 80 from the inlet of the well casing 22. The selected distance 80 may vary from well 10 to well 10. In selected embodiments, the selected distance 80 may be less than three feet.

A baffle 78 in accordance with the present invention may have any suitable thickness 82. The thickness 82 may be selected based on consideration of the strength of the material used to form the baffle 78, the type of flow regulation that is desired, the magnitude of the desired pressure drop, and the like. In certain embodiments, the baffle 78 may be formed of a sheet of steel having a thickness 82 less than one inch.

In selected embodiments, the well casing 22 and water extraction conduit 32 may be a right circular cylindrical in shape. Thus, the gas flow path 44 may have the shape of a cylindrical annulus. Accordingly, in certain embodiment, a baffle 78 in accordance with the present invention may be formed as an annular disk 78 to occupy a portion of the gas flow path 44 at a location between the inlet and outlet of the well casing 22. In certain embodiments, a baffle 78 may have an engagement aperture 84 provide with a diameter 85 sized to accommodate the outer diameter 86 of the water extraction conduit 32. A baffle 78 may have an outer diameter 88 sized to fit within the inner diameter 54 of the well casing 22.

In selected embodiments, the outer diameter 88 of the baffle 78 may be measurably less than the inner diameter 54 of the well casing 22 to provide a clearance 90. The clearance 90 may be sized to permit water 40 to return the well bore 28 by running along the interior surface 46 of the well casing 22 without interference, or with less interference, from the baffle 78.

In certain embodiments, a baffle 78 in accordance with the present invention may act as a screen 78. A screen 78 may be defined as a baffle 78 with apertures 92 distributed substantially evenly thereacross to cause a reduced effective hydraulic diameter (4×area/wetted perimeter) permitting a fluid 40, 42 to pass therethrough. In one embodiment, a baffle 78*a* may have multiple circular apertures 92 distributed thereacross. In another embodiment, a baffle 78*b* may have multiple oval apertures 92 distributed thereacross. In another embodiment, a baffle 78*c* may have multiple angled apertures 92 distributed thereacross to generate a circular or circumferential flow pattern in fluids 40, 42 passing therethrough. In yet another embodiment, a baffle 78*d* may have multiple circumferentially oriented oval apertures 92 distributed thereacross. In still another embodiment, a baffle 78*e* may have multiple notches 92, rather than apertures 92, distributed thereacross.

If desired or necessary, a baffle 78 in accordance with the present invention may have a wiring aperture 94, a wiring notch 96, or both an aperture 94 and a notch 96 formed therein. Either or both of the aperture 94 and notch 96 may provide a location for power transmission lines 36 or instrument wiring 38 to pass by or through the baffle 78. In certain embodiments, an aperture 94 or notch 96 may be shaped and positioned to provide a guard to protect the wires 36, 38 against abrasion as the pump 30, water extraction conduit 32, and baffle are lowered into a well casing 22.

Figure 6:
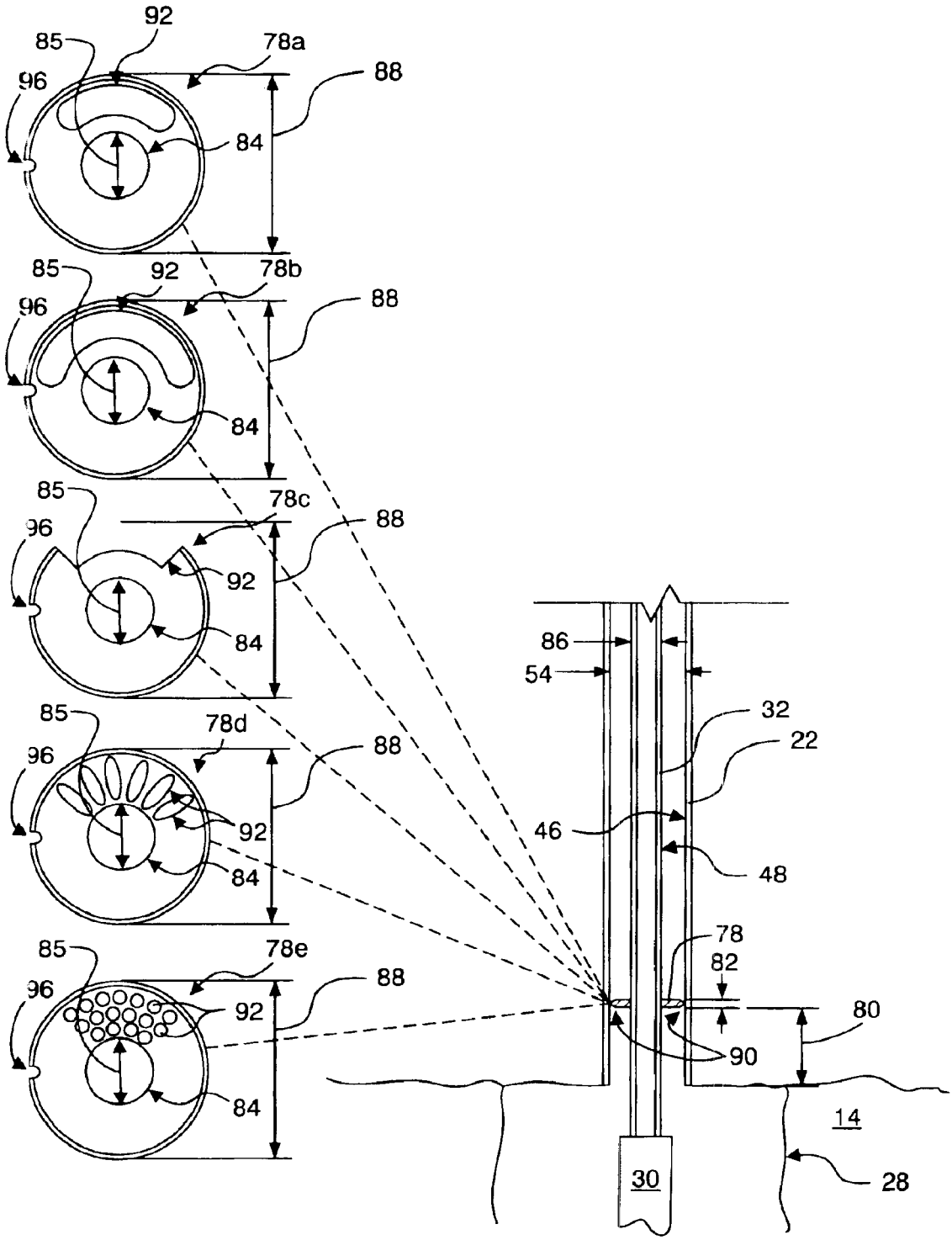
FIG. 6 is partial, cross-sectional side elevation view of a coal bed methane well illustrating various alternative embodiments of trap baffles in accordance with the present invention.

Referring to FIG. 6, in certain embodiments, a baffle 78 in accordance with the present invention may act as a trap 78. A trap 78 may be defined as a baffle 78 with an aperture 92 or grouping of apertures 92 eccentrically located to permit a fluid 40, 42 to selectively pass therethrough, while requiring an associated abrupt change of direction, depending on an impingement location of the fluid 40, 42 before or after the apertures 92.

In one embodiment, a baffle 78*a* may have an aperture 92 placed eccentrically therein. In another embodiment, a baffle 78*b* may have a large aperture 92 placed eccentrically therein. In another embodiment, a baffle 78*c* may have a large notch 92, rather than an aperture 92, placed eccentrically therein. In yet another embodiment, a baffle 78*d* may have multiple oval apertures 92 grouped eccentrically therein. In still another embodiment, a baffle 78*e* may have multiple circular apertures 92, grouped eccentrically therein.

Figure 7:
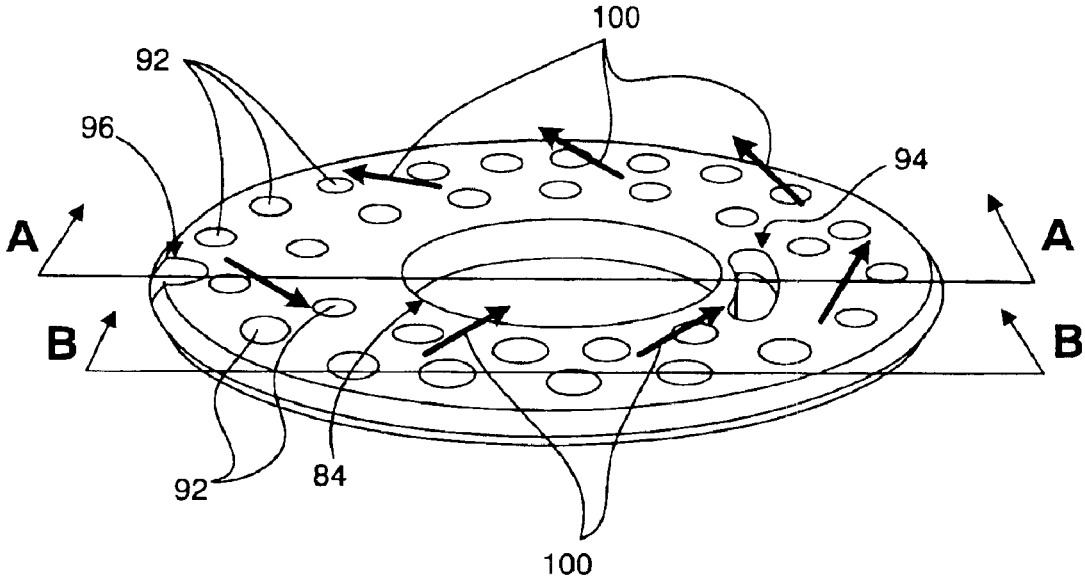
FIG. 7 is a perspective view of an embodiment of a baffle for generating a desired flow pattern in accordance with the present invention.
Figure 8:
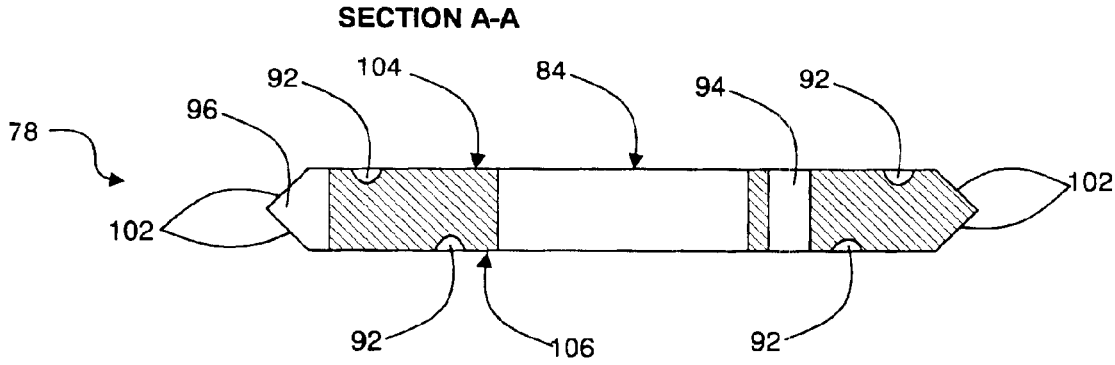
FIG. 8 is a cross-sectional side elevation view of the baffle of FIG. 7.
Figure 9:
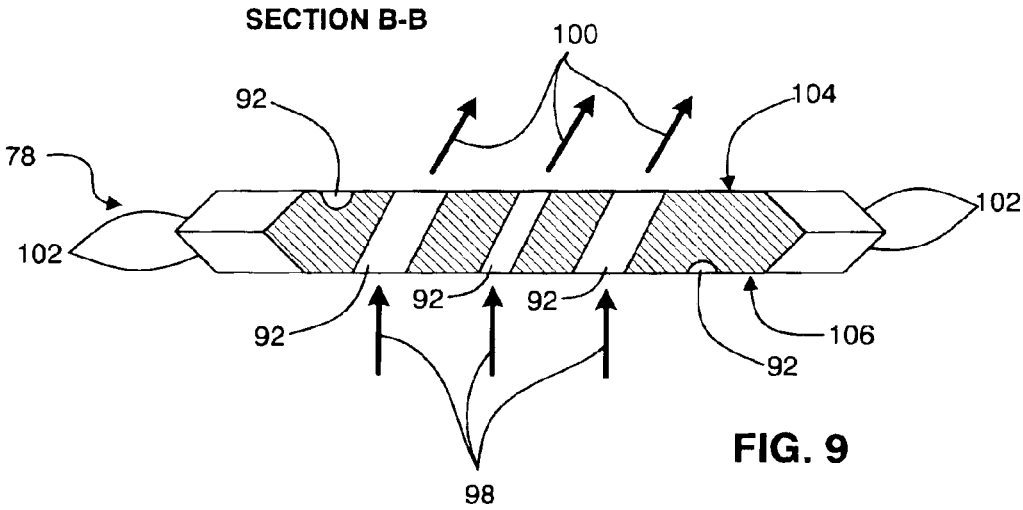
FIG. 9 is another cross-sectional side elevation view of the baffle of FIG. 7.

Referring to FIGS. 7–9, as mentioned hereinabove, a baffle 78 in accordance with the present invention may be arranged to generate a desired flow pattern in fluid 40, 42 passing therethrough or thereby. For example, an angled aperture 92 may permit a baffle 78 to impose a desired flow pattern on fluid 40, 42 passing therethrough. In certain embodiments, certain apertures 92 may be arranged to receive perpendicular flow 98 and deflect the flow 98 to obtain a vortex flow 100. In certain applications, vortex flow 100 may function as a cyclone separator to assist in segregating the water 40 and gas 42.

If desired or necessary, a baffle 78 in accordance with the present invention may be formed with a chamfer 102 or bevel 102 on a top surface 104, a bottom surface 106, or both 104, 106. A chamfer 102 may reduce the possibility of the baffle 78 catching or snagging on the various seams, joints, and/or imperfections that are part of the interior surface 46 of the well casing 22. The chamfer 102 may tend to deflect the baffle 78 away from potential snagging points. A chamfer 102 on the bottom surface 106 may resist snags when the pump 30, water extraction conduit 32, and baffle 78 are being lowered into the well casing 22. A chamfer 102 on the top surface 104 may resist snags when the pump 30, water extraction conduit 32, and baffle 78 are being lifted out of the well casing 22. A chamfer 102 also tends to minimize binding due to any misalignments.

Figure 10:
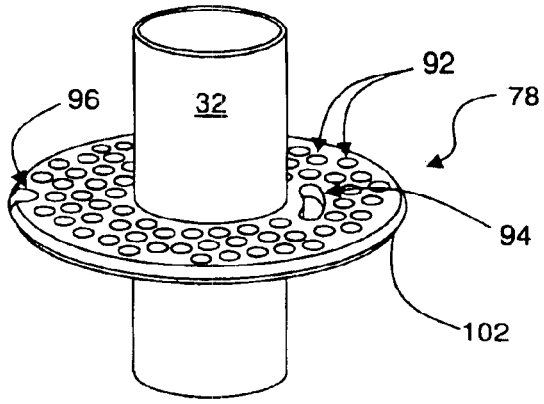
FIG. 10 is a perspective view of a single plate, screen baffle placed on a water extraction conduit in accordance with the present invention.
Figure 11:
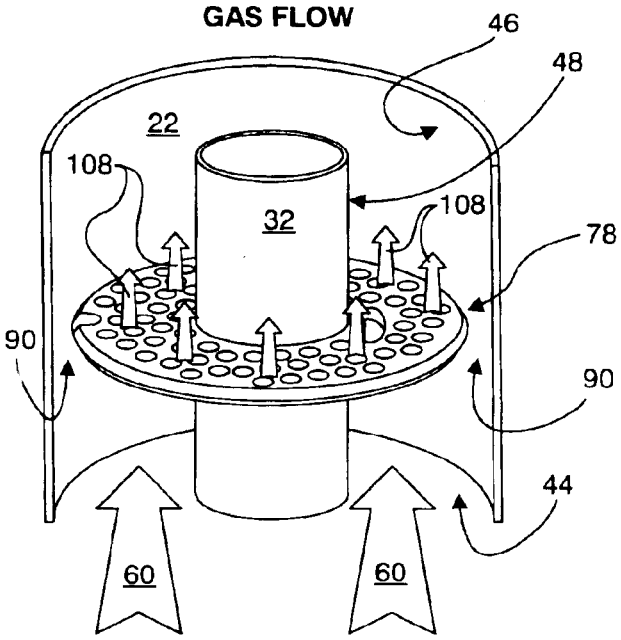
FIG. 11 is a cut-away perspective view of the single plate, screen baffle of FIG. 10 placed within a well casing with generally trending gas flow patterns indicated, although the dynamics of fluid flow may promote instantaneous flows in virtually any direction in any configuration discussed or illustrated within this specification, and this applies whether or not specifically restated herein.
Figure 12:
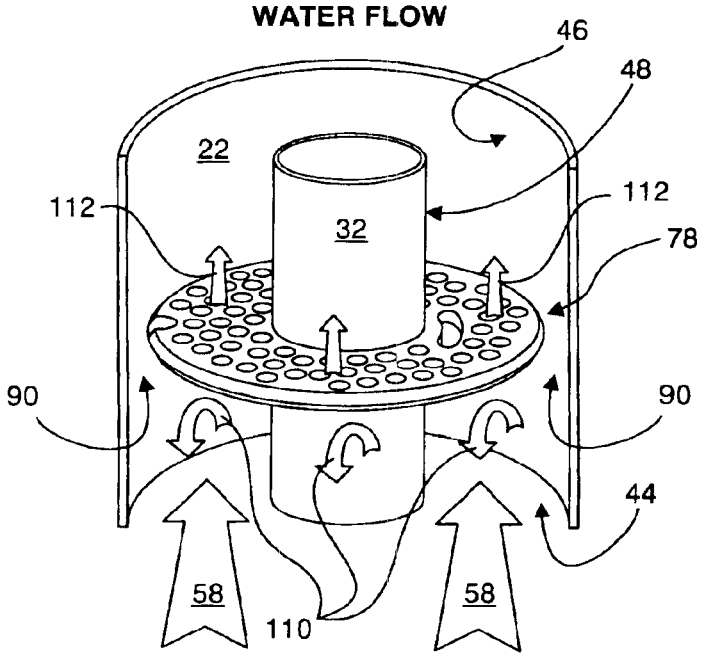
FIG. 12 is a cut-away perspective view of the single plate, screen baffle of FIG. 10 placed within a well casing with water flow patterns indicated.

Referring to FIGS. 10–12, in certain embodiments, a baffle 78 in accordance with the present invention may constitute a single plate baffle 78. In selected embodiments, a single plate baffle 78 may be formed of a trap 78. In another embodiment, a single plate baffle 78 may be formed of a screen baffle 78.

A screen baffle 78 may distinguish between water 40 and gas 42 based on viscosity. The fluid 40, 42 with the lower viscosity will be able to pass through the baffle 78 the fastest with the least pressure drop. Thus, when a gas pocket 60 impinges on the baffle 78, gas 42 is more readily able to redistribute into small gas pockets 108 and pass through in a fairly short period of time. In contrast, when a water slug 58 impinges on the baffle 78, a significant amount of water 40 is rejected 110. Any water 40 that passes through has to be in the form of small water pellets 112, which have much less potential to form complete annular water slugs 58 within the gas flow path 44 and have lost significant momentum.

Figure 13:
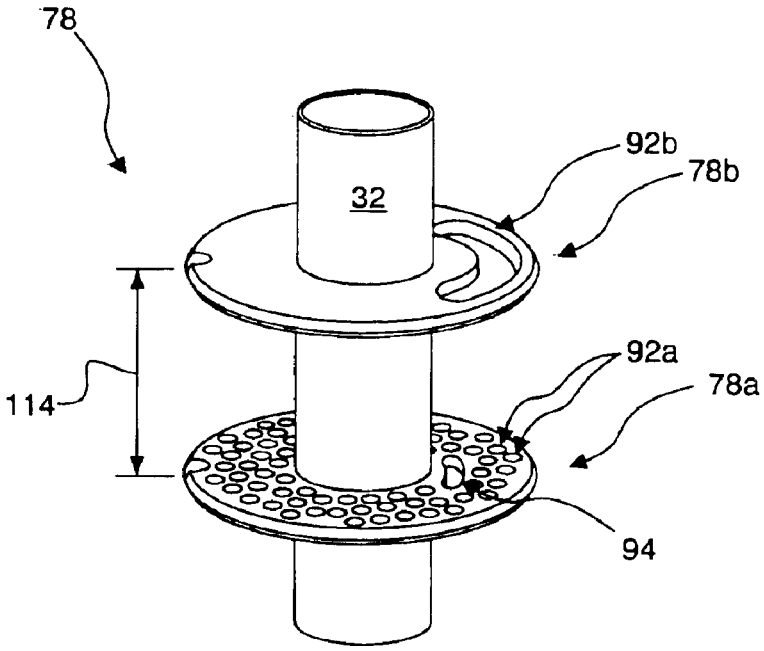
FIG. 13 is a perspective view of a double plate, screen and trap baffle placed on a water extraction conduit in accordance with the present invention.
Figure 14:
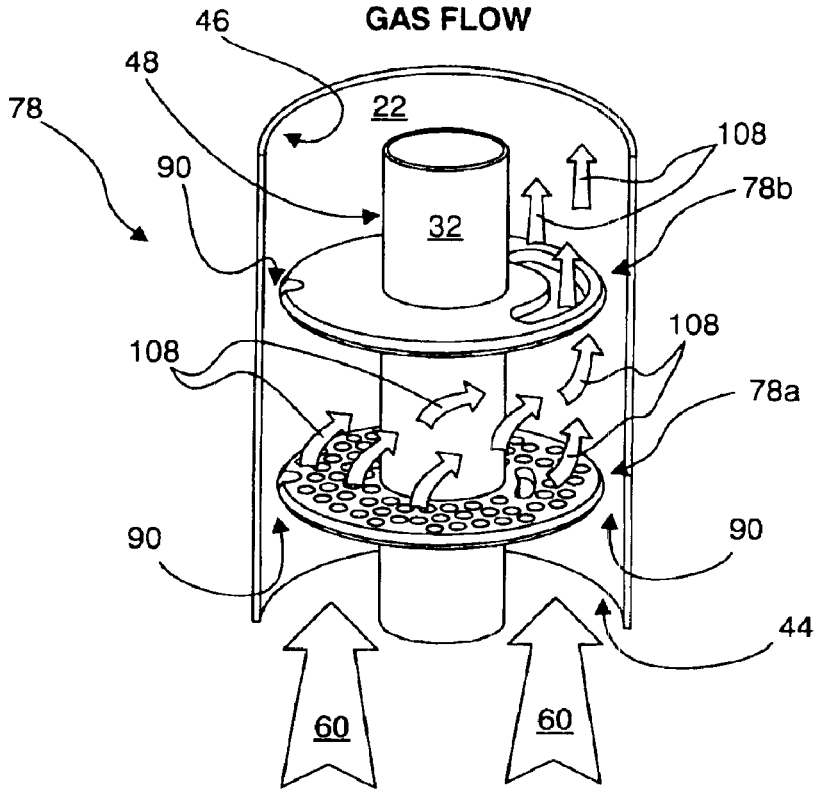
FIG. 14 is a cut-away perspective view of the double plate, screen and trap baffle of FIG. 13 placed within a well casing with gas flow patterns indicated.
Figure 15:
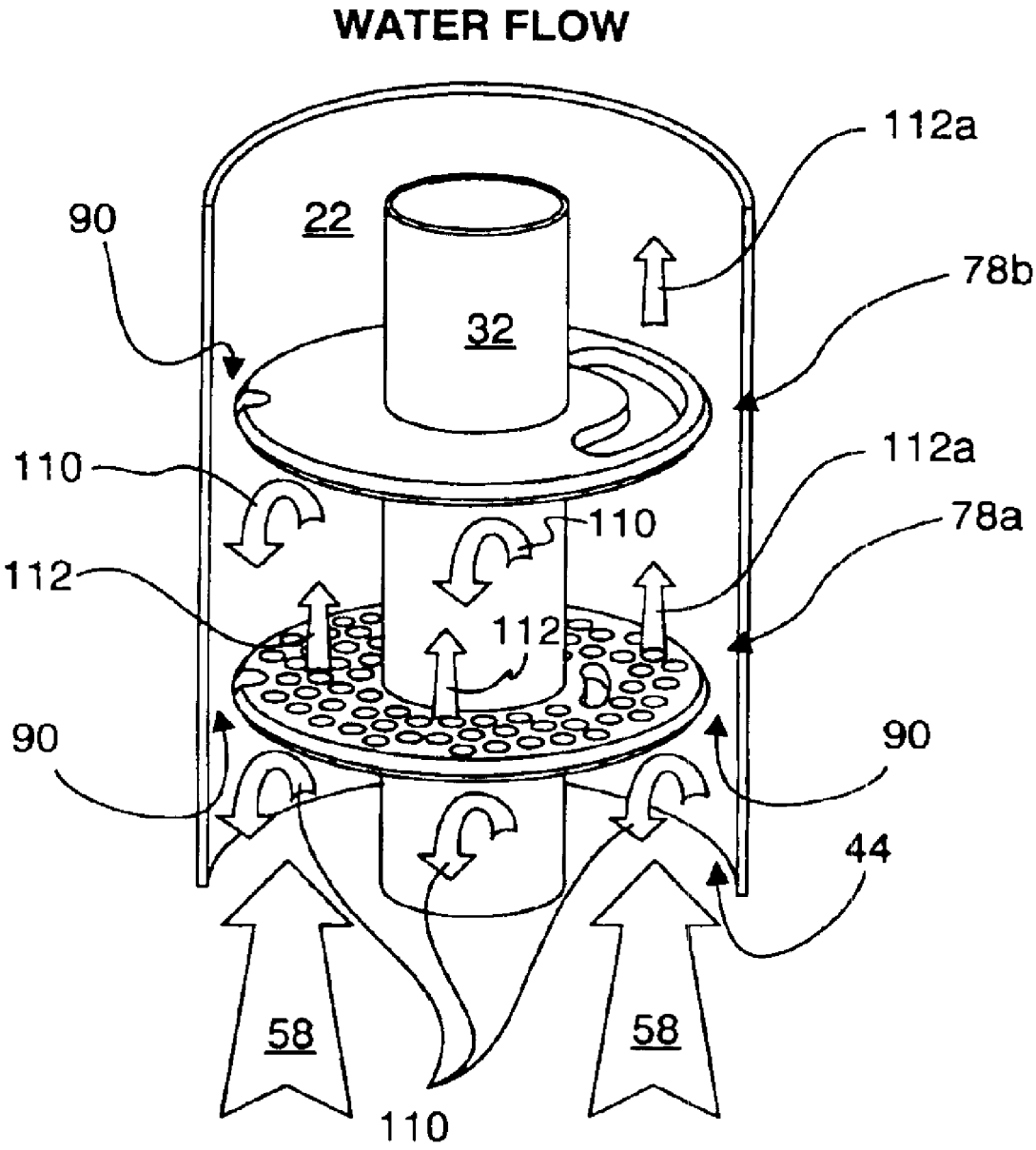
FIG. 15 is a cut-away perspective view of the double plate, screen and trap baffle of FIG. 13 placed within a well casing with water flow patterns indicated, although the dynamics of fluid flow may promote instantaneous flows in virtually any direction.

Referring to FIGS. 13–15, in certain embodiments, a baffle 78 in accordance with the present invention may constitute a double plate baffle 78. In selected embodiments, a double plate baffle 78 may be formed of two screen baffles 78*a* spaced from one another. In another embodiment, a double plate baffle 78 may be formed of two trap baffles 78*b* spaced from one another. In yet another embodiment, a double plate baffle 78 may be formed of a screen baffle 78*a* spaced from a trap baffle 78*b*.

A screen and trap baffle 78 may distinguish between water 40 and gas 42 based on viscosity and inertia. Generally, fluids that are heavier or more dense require a greater amount of energy and momentum exchange to overcome inertia and change directions. Thus, fluids may be segregated based the energy or momentum required to change directions quickly. Nature prefers the low energy solution over the high energy solution. In a screen and trap baffle 78, the fluid 40, 42 with the lower viscosity and the greatest ability to change direction of motion with minimum momentum exchange will have the advantage in continuing along the path 44.

When a gas pocket 60 impinges on a screen baffle 78*a*, the gas 42 is able to redistribute into small gas pockets 108 and pass through in a comparatively short period of time with a comparatively small loss of momentum. In contrast, when a water slug 58 impinges on a screen baffle 78*a*, a significant amount of water 40 is rejected 110. Any water 40 that passes through has to be in the form of small water pellets 112, which have lost momentum and much of the potential to form into complete annular water slugs 58 within the gas flow path 44.

Any small gas pockets 108 or water pellets 112 that pass through the screen baffle 78*a* may advance to the trap baffle 78*b*. The trap baffle 78*b* may be spaced a selected distance 114 from the screen baffle 78*a* selected so that an eccentrically located aperture 92 in the trap baffle 78*b* may force the majority of small gas pockets 108 and water pellets 112 to change direction in order to pass through. Because of comparatively low energy and momentum exchange required to overcome the inertia of the small gas pockets 108, more of the small gas pockets 108 are more likely to change direction and pass through the aperture 92.

Water pellets 112, on the other hand, require more energy and momentum exchange than the small gas pockets 108 to redirect their flow. Thus, it is more likely that many of the water pellets 112 may impinge upon the trap baffle 78 and cease their advance up the gas flow path 44. Only water, derived from those water pellets 112*a* that manages to exit the screen baffle 78*a* with a flow direction toward the aperture 92 in the trap baffle 78*b* will be likely to pass completely through the baffle 78.

The spacing 114 between the plates 78*a*, 78*b* of a double plate baffle 78 may be selected to promote the desired flow result or pressure drop. The smaller the spacing 114, the less time the small gas pockets 108 and water pellets 112 have, after passing through the first plate 78*a*, to redistribute or conglomerate before impinging on the second plate 78*b*. It appears that the smaller the spacing 114 the more exclusive the baffle 78. Thus, the spacing 114 may be selected to provided the desired exclusivity. In one embodiment, the spacing 114 may be in the range of two to twelve inches.

Figure 16:
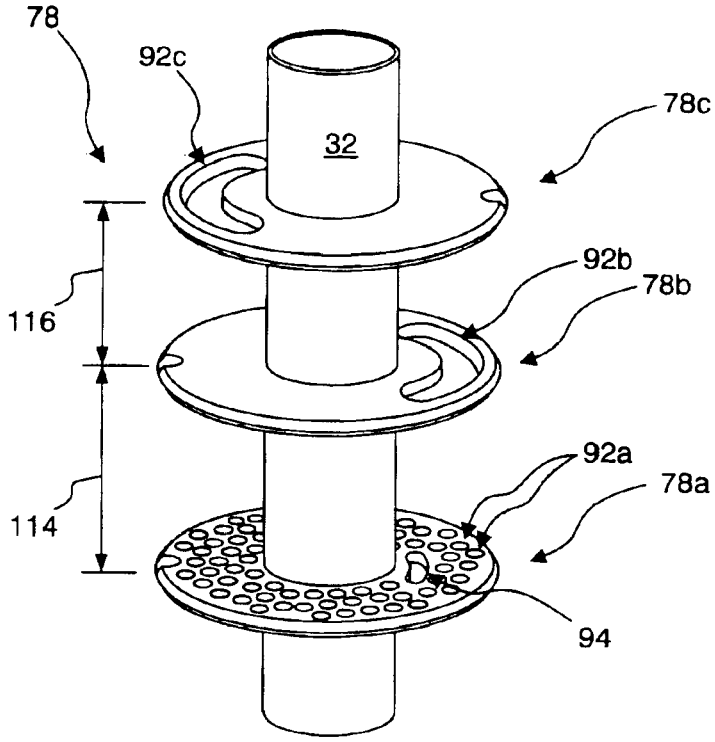
FIG. 16 is a perspective view of a triple plate, screen and multi-trap baffle placed on a water extraction conduit in accordance with the present invention.
Figure 17:
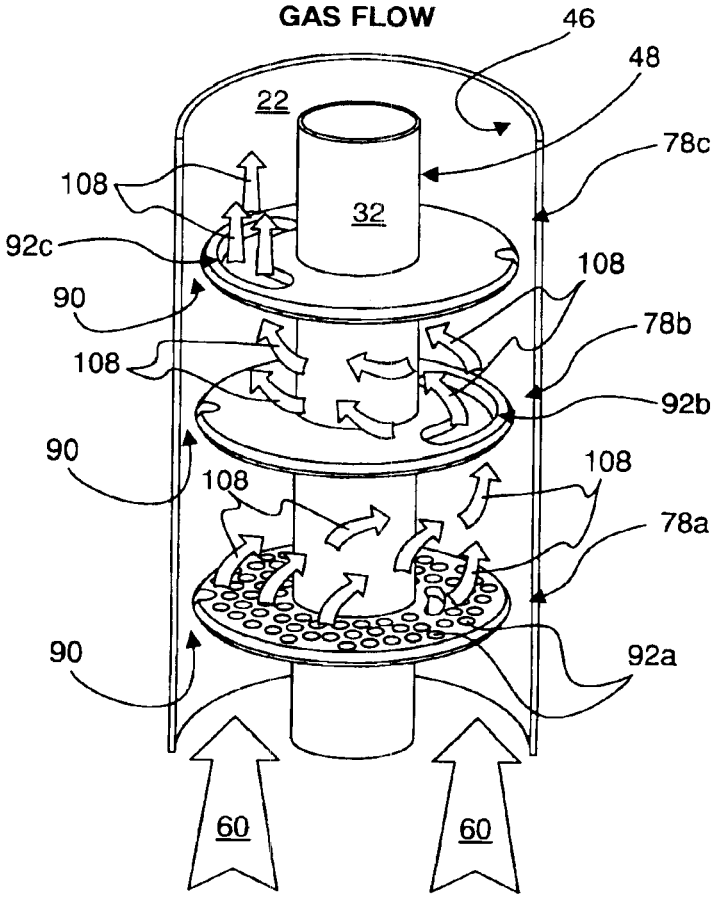
FIG. 17 is a cut-away perspective view of the triple plate, screen and multi-trap baffle of FIG. 16 placed within a well casing with gas flow patterns indicated, although the dynamics of fluid flow may promote instantaneous flows in virtually any direction.
Figure 18:
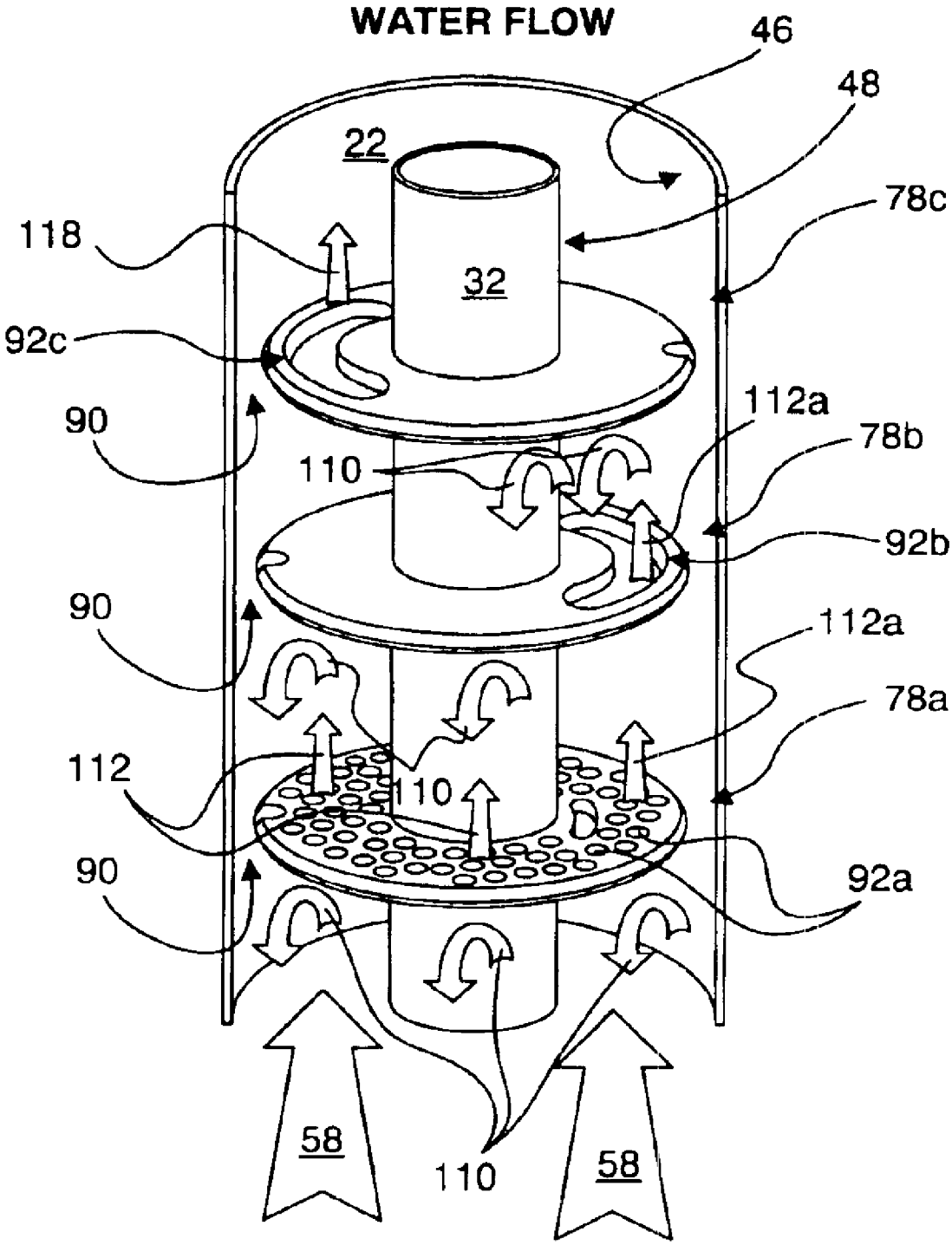
FIG. 18 is a cut-away perspective view of the triple plate, screen and multi-trap baffle of FIG. 16 placed within a well casing with generally trending water flow patterns indicated, although the dynamics of fluid flow may promote instantaneous flows in virtually any direction.

Referring to FIGS. 16–18, in certain embodiments, a system of baffles 78 in accordance with the present invention may constitute a triple plate baffle 78. In selected embodiments, a triple plate baffle 78 may be formed of three screen baffles 78 spaced from one another. In another embodiment, a triple plate baffle 78 may be formed of three trap baffles 78 spaced from one another. In yet another embodiment, a triple plate baffle 78 may be formed of a combination of various trap and screen baffles 78 spaced from one another.

In one embodiment, a triple plate baffle 78 may be formed of a screen baffle 78*a* and two trap baffles 78*b*, 78*c*. Similar to a double plate, screen-and-trap baffle 78, the triple plate, screen-and-trap baffle 78 may separate water 40 and gas 42 based on viscosity and inertia. Thus, the fluid 40, 42 with the lower viscosity and the greatest ability to change direction of motion will have the advantage.

When a gas pocket 60 impinges on the screen baffle 78*a*, all the gas 42 is able to redistribute into small gas pockets 108 pass through as in a fairly short period of time with a comparatively small loss of momentum. In contrast, when a water slug 58 impinges on the baffle 78*a*, a significant amount of water 40 is rejected 110. Any water 40 that makes it through has to be in the form of small water pellets 112, which have much less potential to form complete annular water slugs 58 within the gas flow path 44.

Any small gas pockets 108 or water pellets 112 that pass through the screen baffle 78*a* may advance to a first trap baffle 78*b*. The first trap baffle 78*b* may be spaced a selected distance 114 from the screen baffle 78*a*. In certain embodiments, an eccentrically located aperture 92*b* in the first trap baffle 78*b* may force the majority of small gas pockets 108 and water pellets 112 to change direction and breakup if they are to pass through. Because of comparatively low energy and momentum required to overcome the inertia of the small gas pockets 108, the small gas pockets 108 are more likely to pass through the aperture 92*b* than are the water drops 112.

Water pellets 112 (droplets 112, flows 112) at a given velocity, on the other hand, require more energy and momentum than the small gas pockets 108 to redirect their direction of flow. Thus, it is more likely that many of the water pellets 112 may impinge upon the trap baffle 78*b* and cease their advance up the gas flow path 44. Only those water pellets 112*a* or droplets 112*a* that exist and exit the screen baffle 78*a* with a flow direction toward the aperture 92 in the first trap baffle 78*b* are likely to pass and advance to a second trap baffle 78*c*.

A second trap baffle 78*c* may placed with in the gas flow path 44 and spaced a selected distance 116 from the first trap baffle 78*b*. In selected embodiments, a second trap baffle 78*c* may be positioned to provided with an eccentrically located aperture 92*c* misaligned with the eccentrically locate aperture 92*b* on the first trap baffle 78*b*. Thus, the second trap baffle 78*c* may force any small gas pockets 108 are water pellets 112*a* that passed through the aperture 92*b* to change directions, break up, or both if they are to pass through aperture 92*c*. Due to the comparatively low energy and momentum required to overcome the inertia of the small gas pockets 108 at the flow velocity, the small gas pockets 108 are more likely to pass through aperture 92*c* and exit the baffle 78 completely.

Water pellets 112*a* at the flow velocity, on the other hand, require more energy and momentum than the small gas pockets 108 to redirect their direction of flow and overcome drag. Thus, it is more likely that many of the water pellets or residual water therefrom 112*a* may impinge upon the second trap baffle 78*c* and cease their advance up the gas flow path 44. A comparatively small volume of fraction water 118 may pass entirely through the baffle 78.

In certain embodiments, the spacing 114 between the plates 78*a*, 78*b* and the spacing 116 between plate 78*b* and 78*c* of a triple plate baffle 78 may be selected to promote a desired flow result or pressure drop. The smaller the spacings 114, 116 the less time the small gas pockets 108 and water pellets 112 have to redistribute or conglomerate before impinging on the next successive plate. It appears that the smaller the spacings 114, 116, the more exclusive the baffle 78. Thus, the spacings 114, 116 may be selected to provided the desired exclusion or "flow re-distribution" of materials.

In one embodiment, the spacing 114 between the screen baffle 78*a* and first trap baffle 78*b* may be selected to be greater or less than the spacing 116 between the first trap baffle 78*b* and second trap baffle 78*c*. The difference in the spacings 114, 116 may be selected to avoid the potential for excitation of resonant frequencies with the baffle 78. In one embodiment, both spacings 114, 116 may be in the range of about two to twelve inches.

Figure 19:
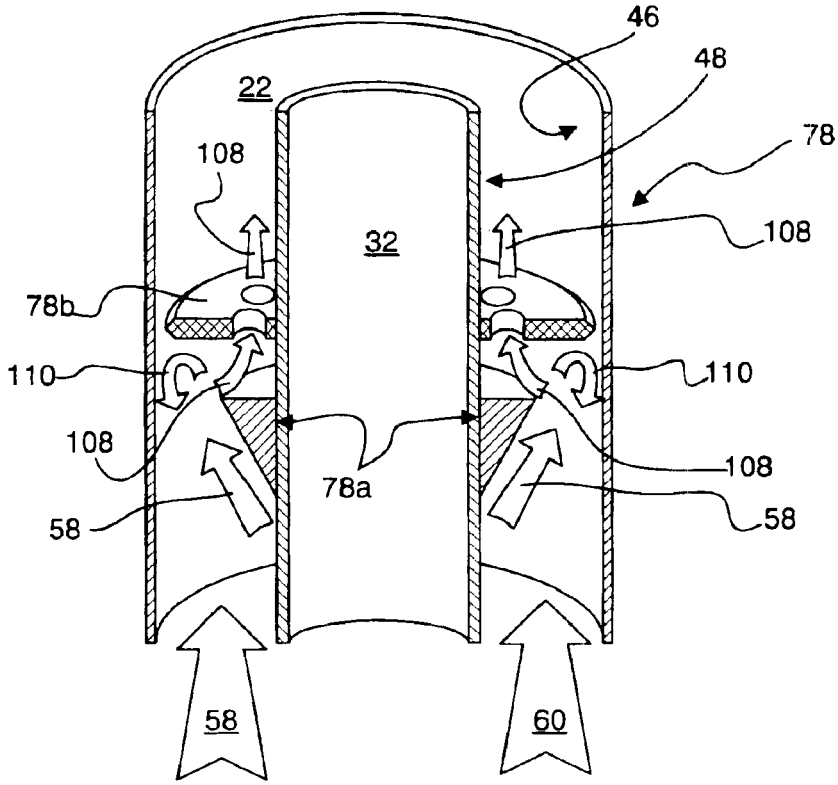
FIG. 19 is a perspective, cross-sectional view of an alternative embodiment of a baffle in accordance with the present invention.

Referring to FIG. 19, in certain embodiments, a baffle 78 in accordance with the present invention may include a deflector 78*a* and a screen 78*b*. The deflector 78*a* may be shaped as a wedge 78*a* to deflect water slugs 58 and gas pockets 60 passing thereby toward the well casing 22. A screen baffle 78*b* may be spaced from the deflector 78*a* and provide an impingement location 120 for the deflected flows of water 58 and gas 60. The impingement location 120 may cause the water slugs 58 and gas pockets 60 to break into small gas pockets 108 and water pellets 112. Since the small gas pockets 108 are less viscous and dense than the water pellets 112, the small gas pockets 108 may best recover from the inertial disruption and be first to pass through the apertures 92 in the screen baffle 78*b* and proceed up the gas flow path 44.

Figure 20:
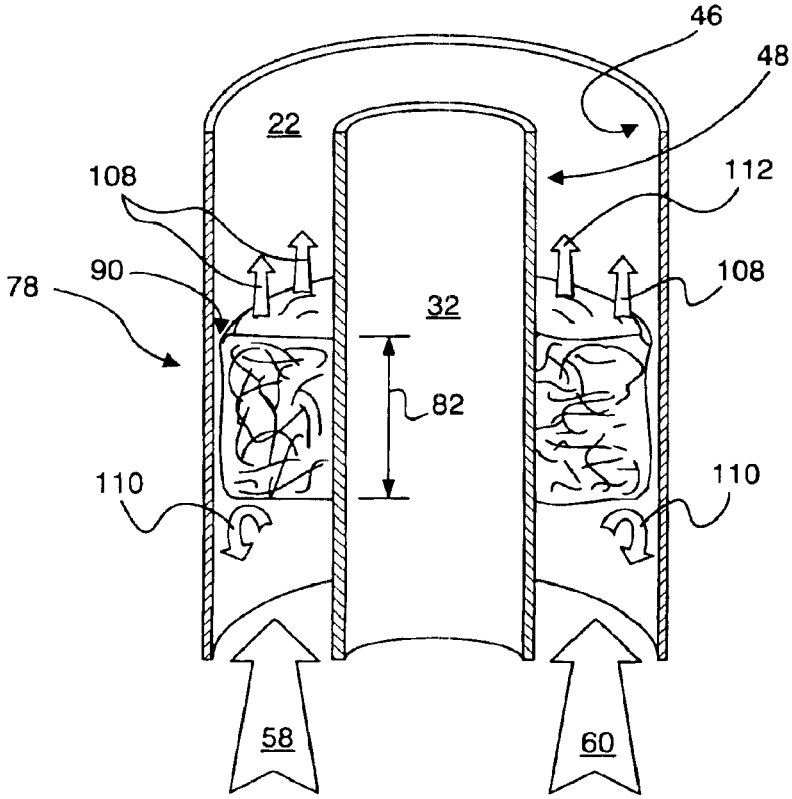
FIG. 20 is a perspective, cross-sectional view of another alternative embodiment of a baffle in accordance with the present invention.

Referring to FIG. 20, in selected embodiments, a baffle 78 in accordance with the present invention may be formed of a porous material imposing a tortuous path 122 on fluids passing therethrough. The tortuous path 122 may provide a differentiation of the flows of fluids based on viscosity. A volume of less viscous fluid, such as a gas 60, may pass through the baffle 78 faster than more viscous fluids like water 58 or oil.

A porous baffle 78 may be formed to be rigid or to be deflectable. Accordingly, a porous baffle 78 may be formed of any suitable material providing the desired porosity and rigidity, or lack thereof. Suitable materials may include metals, metal alloys, polymers, reinforced polymers, composites, and the like. The thickness 82 of a porous baffle 78 may be selected to provide sufficient strength or resilience for the baffle 78 to perform as desired. The thickness 82 of a porous baffle 78 may be varied to provide a desired pressure drop in fluids passing therethrough.

Figure 21:
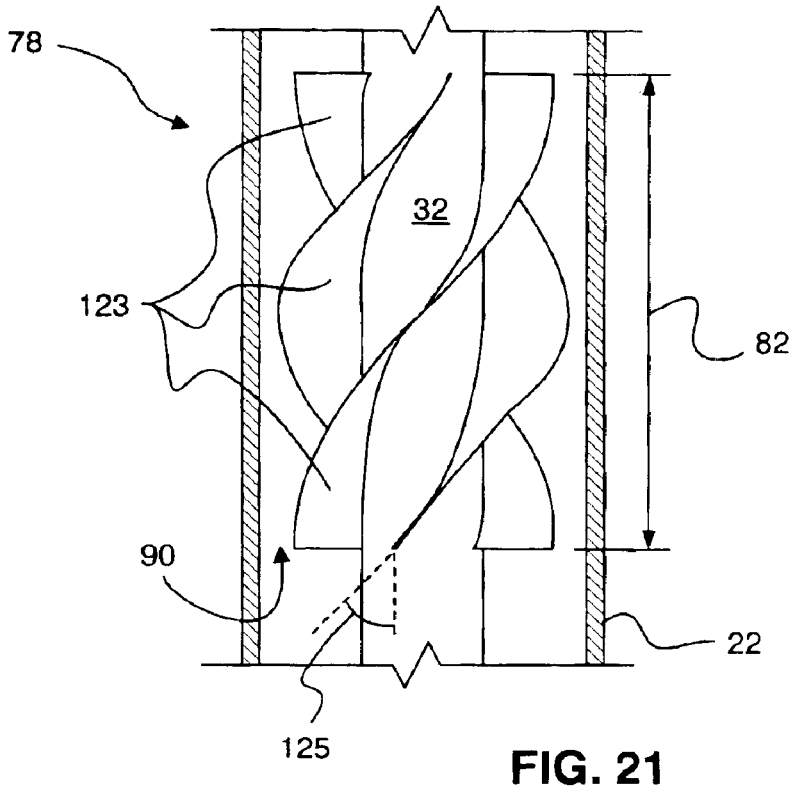
FIG. 21 is a partial cut-away, side elevation view of an embodiment of a vortex-generating baffle in accordance with the present invention.
Figure 22:
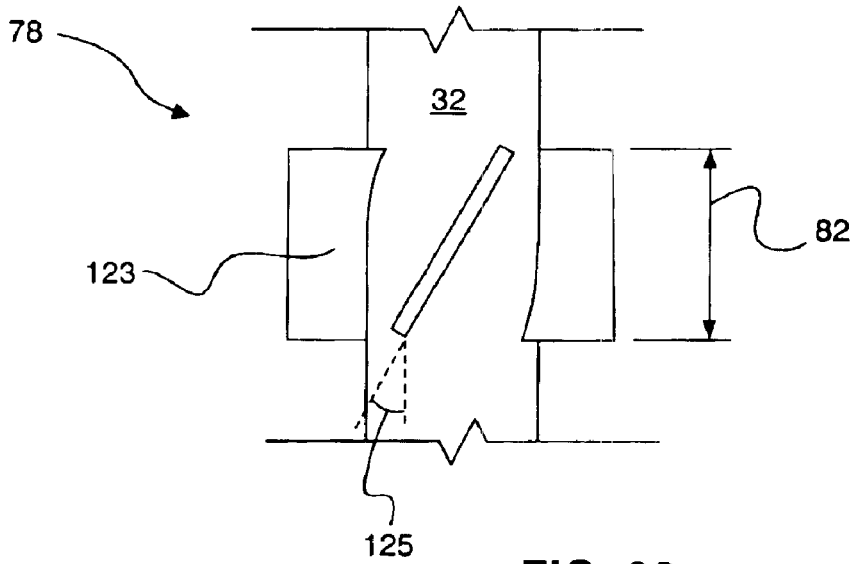
FIG. 22 is a side elevation view of an alternative embodiment of a vortex-generating baffle in accordance with the present invention.

Referring to FIGS. 21–22, a baffle 78 in accordance with the present invention may be shaped to generate a desired flow pattern. For example, a baffle 78 may be formed with vanes 123 positioned to direct the flow of gas 60 or water 58 therethrough. The thickness 82 of the vaned baffle 78 may be selected to provide sufficient redirection of a fluid passing therethrough. In selected embodiments, vanes 123 in accordance with the present invention may be shaped to conform to the shape of a water extraction conduit 32. In other embodiments, vanes 123 may be formed in a simple planar shape. Vanes 123 may be secured by any suitable method. In one embodiment, vanes 123 may be secured to a water extraction conduit 32 by welding.

In certain embodiments, vanes 123 may be positioned at an angle 135 with respect to the a water extraction conduit 32. Vortex flow 100 may send more dense material like water 58 to the exterior of the gas flow path 44 (i.e. proximate the interior surface 46 of the well casing 22). Thus, the interior of the flow path 44 (i.e. proximate the exterior surface 48 of the water extraction conduit 32) may be vacated, permitted gas 60 to more easily flow therethrough. In one embodiment, the vanes 123 may be formed with a clearance 90 to avoid interference with water running down a well casing 22.

Referring to FIGS. 5–22, those of skill in the art will recognize that there are myriad patterns, shapes, and designs that may be used as a baffle 78 in accordance with the present invention. Accordingly, any device baffle 78 that deflects, checks, or regulates flow to preferentially permit the flow of the volume of gas 60 over the water 58 of a two-phase flow therethrough or thereby may be considered a baffle 78 within the scope of the present invention.

Figure 23:
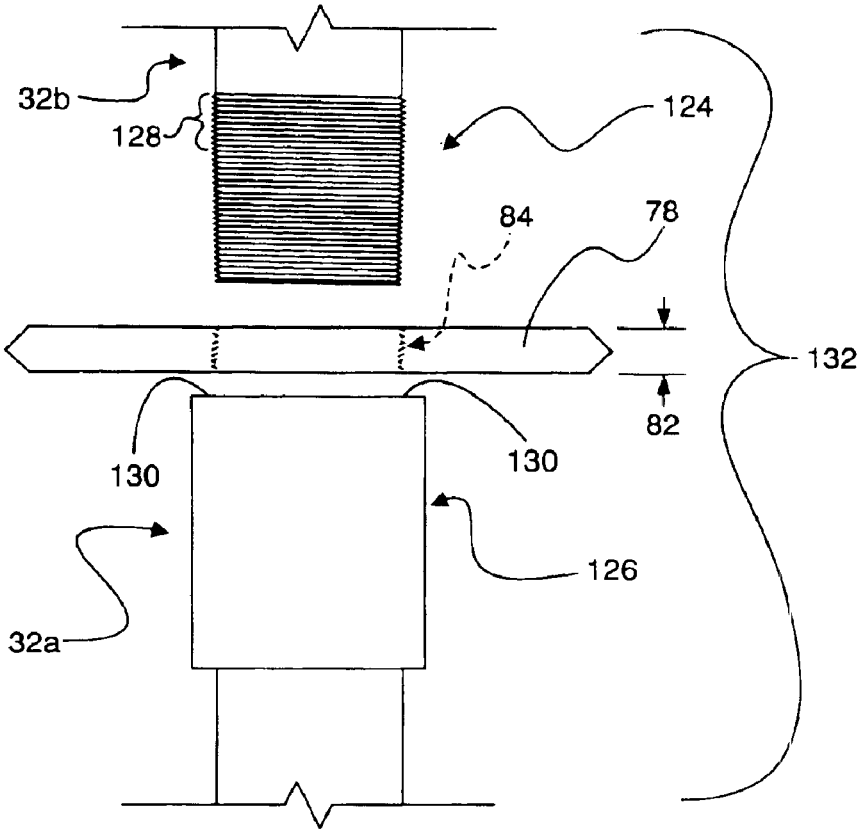
FIG. 23 is an exploded side elevation view of a baffle attached to a conduit in accordance with the present invention.
Figure 24:
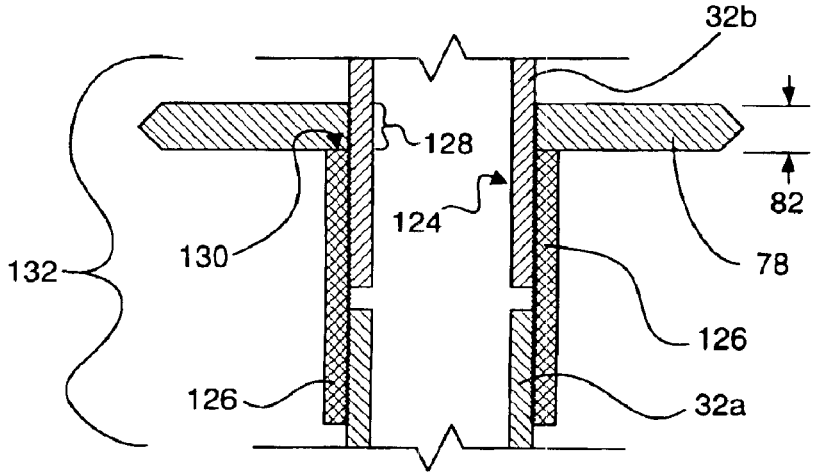
FIG. 24 is a cross-sectional side elevation view of the baffle and conduit of FIG. 23 once assembled in accordance with the present invention.

Referring to FIGS. 23 and 24, a baffle 78 in accordance with the present invention may be positioned and secured within the gas flow path 44 in any suitable manner. In certain embodiments, as discussed hereinabove, a baffle 78 may have an engagement aperture 84 sized to receive the water extraction conduit 32 therewithin.

A water extraction conduit 32 may be provided in sections 32*a*, 32*b*. Each section 32*a*, 32*b* has a threaded male end 124 and a threaded female end 126 or coupler 126. Thus, a conduit 32 may be assembled end 124 to end 126 until the total desired length and number of baffles 78 are achieved. In selected embodiments, a baffle 78 may secure to the water extraction conduit 32 at an interface between conduit sections 32*a*, 32*b*.

For example, the threaded male end of a conduit 32 may have additional threads 128 formed therein. The amount of threads may correspond to the thickness 82 of the baffle 78 to be secured thereto. The engagement aperture 84 of the baffle 78 may be formed with corresponding threads. Thus, when assembled, the additional thread 128 provide securement of the baffle 78 without interrupting the securement between the respective ends 124, 126 of adjacent conduit sections 32*a*, 32*b*.

In certain embodiments, the female end 126 may provide a shoulder 130 to stop the baffle 78 from disengaging the conduit 32*b*. The junction of the conduit sections 32*a*, 32*b* and a baffle 78 may create a segment 132. A segment 132 may be repeated in series to provide a desired number of baffle plates 78.

Figure 25:
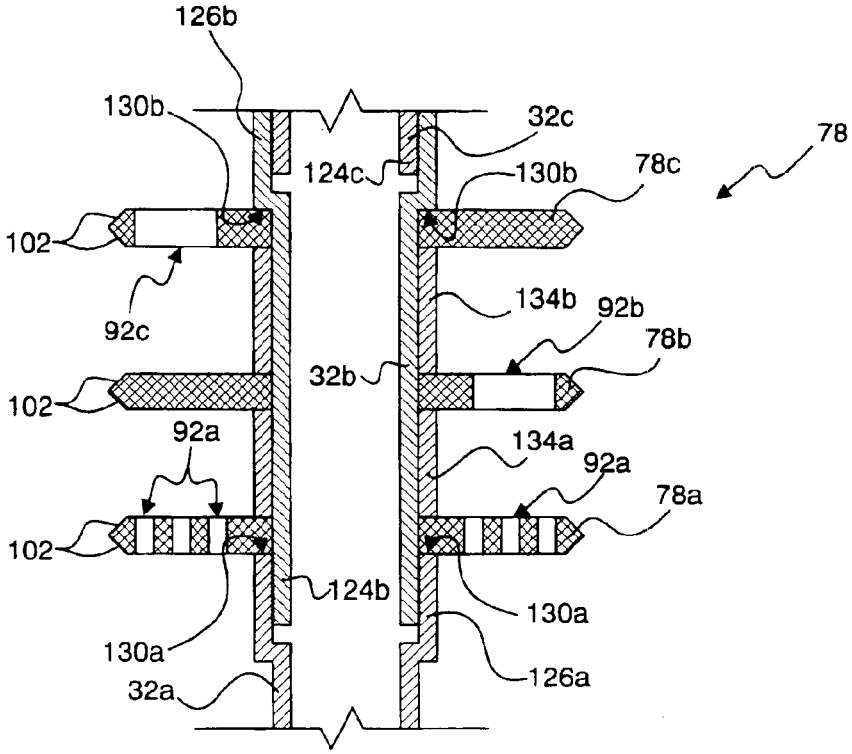
FIG. 25 is a cross-sectional side elevation view of an alternative embodiment of a baffle assembly in accordance with the present invention.

Referring to FIG. 25, in certain embodiments, baffles 78 in accordance with the present invention may be formed with an engagement aperture 84 sized to provide a slip fit with a water extraction conduit 32. Baffles 78 may be held in place or sandwiched between shoulders 130*a*, 130*b* of adjacent conduit sections 32*a*, 32*b*. In certain multi-plate baffles 78, sleeves 134 or collars 134 may provide spacing between plates 78*a*, 78*b*, 78*c*. If desired, sleeves 134 may provide spacing between shoulder 130*a*, 130*b* and baffles 78.

Figure 26:
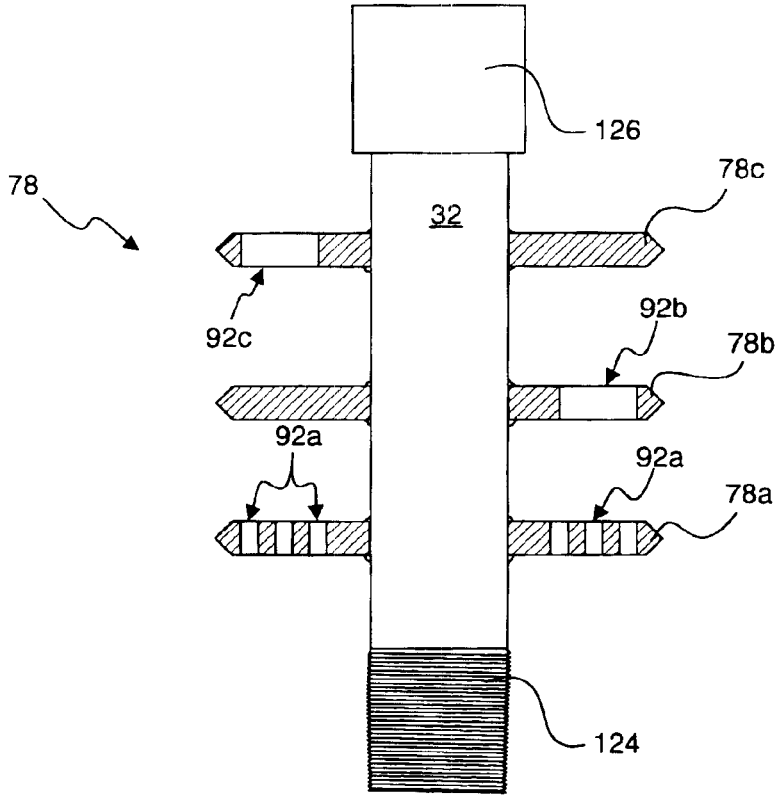
FIG. 26 is a cross-sectional side elevation view of another alternative embodiment of a baffle assembly in accordance with the present invention.

Referring to FIG. 26, a baffle 78 in accordance with the present invention may be welded to the water extraction conduit 32. In one embodiment, a baffle 78 may be formed with an engagement aperture 84 size to provide a slip fit with a water extraction conduit 32. Once located in on a section of water extraction conduit 32, the baffle may be welded in place. In selected embodiments, multiple plate baffles 78*a*, 78*b*, 78*c* may be welded to a single section of water extraction conduit 32.

Figure 27:
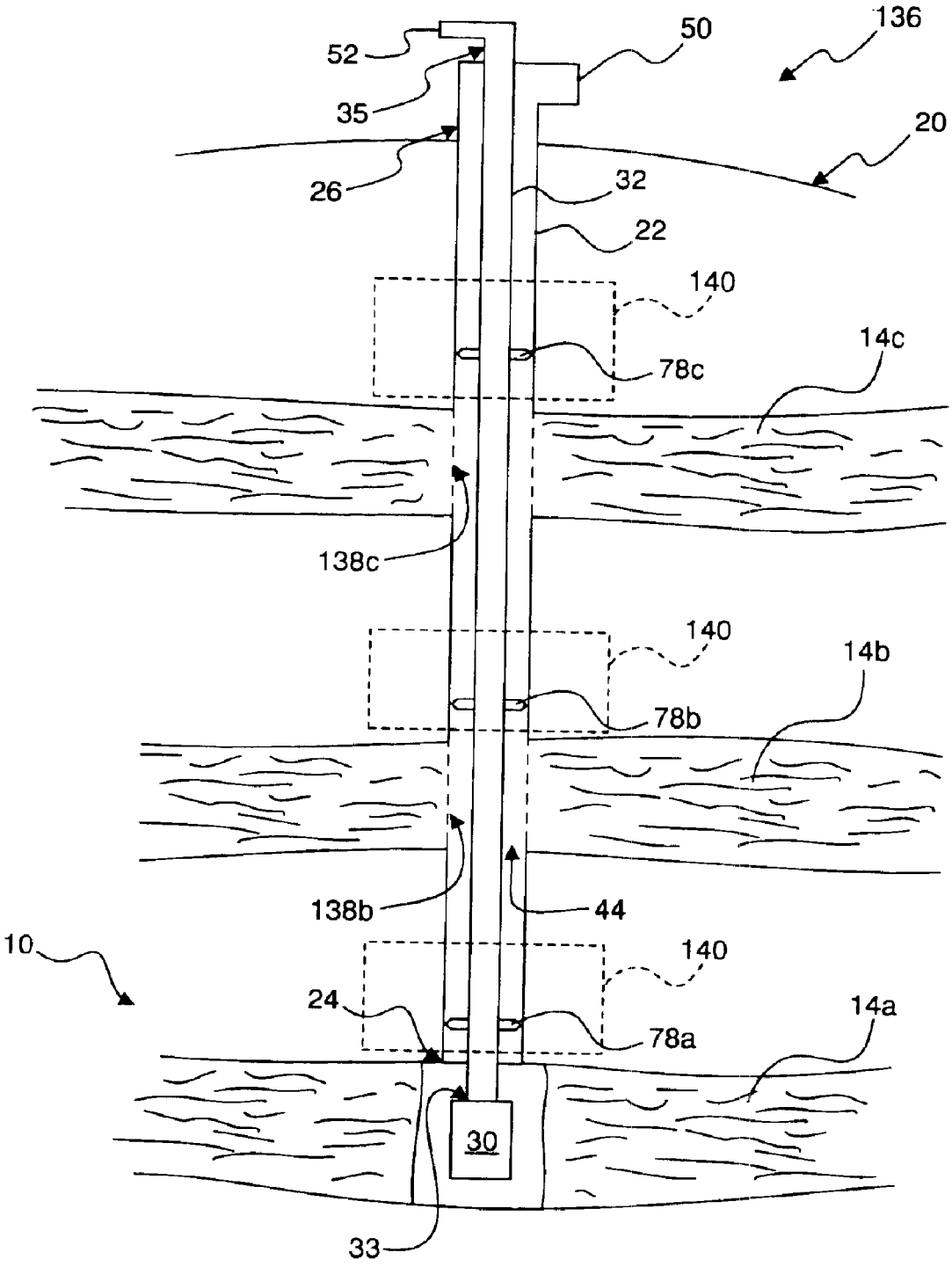
FIG. 27 is a cross-section side elevation view of a multi-zone completion coal bed methane well with multiple baffles applied in accordance with the present invention.

Referring to FIG. 27, in certain applications, it may be desirable to gather methane from a multi-zone completion 136. A multi-zone completion 136 is a single coal bed methane well 10 arranged to collect methane from more than one coal seam 14. In a multi-zone completion 136, a well casing 22 may extend from the surface 20 to the lowest coal seam 14*a*. At locations where the well casing 22 passes through a coal seam 14*b*, 14*c*, perforations 138*b*, 138*c* may be formed in the well casing 22 to allow water and gas to enter the gas flow path 44.

Ideally, multi-zone completions 136 function when water from all coal seams 14*a*, 14*b*, 14*c* travels down the gas flow path 44 and collects in the well bore 28*a* of the lowest coal seam 14*a*. The water may then be pumped to the surface 20 by a pump 30. Gas from each seam 14*a*, 14*b*, 14*c* may travel up the gas flow path 44 to the surface 20 were it may be collected.

Due to the probability for high flow rates of water and gas within the gas flow path 44, the operation of a multi-zone completion 136 may be improved by the use of one or more baffles 78 in accordance with the present invention. Baffles 78 may be placed at any location within the flow path 44 between the inlet 24 and outlet 26 of the well casing 22.

In one embodiment, baffles 78 may be located at baffle regions 140 positioned slightly above each coal seam 14*a*, 14*b*, 14*c*. The baffles 78 may act as restrictions or check valves 78, resisting the upward movement of water entering the gas flow path 44 at each coal seam 14*a*, 14*b*, 14*c*.

It is very likely that different coal seams 14 produce gas and water at different amounts and pressures. However, when multiple coal seams 14 are joined by a multi-zone completion 136, they may seek a common pressure. For example, if a bottom coal seam 14*a* flows gas at a higher pressure than a top coal seam 14*c*, then gas from the bottom coal seam 14*a* may enter the top coal seam 14*c*, rather than flowing to the surface 20 for collection. This process may continue until the gas pressure of the top coal seam 14*c* is equal to the gas pressure of the bottom coal seam 14*a*.

To compensate for the pressure differentials between coal seams 14 communicating through a multi-zone completion 136, baffles 78 in accordance with the present invention may act as pressure regulators or equalizers. As discuss hereinabove, a baffle 78 may be used to impose a pressure drop in fluids flowing therethrough or passing thereby. Thus, a baffle 78 may be strategically placed to induce a pressure drop in gas flowing from a higher pressure coal seam 14*a*. The magnitude of the pressure drop may be selected to match the gas pressure leaving a lower pressure seam 14*c*. Thus, the pressure differential driving gas from one coal seam 14*a* into another coal seam 14*c* may be reduced or eliminated.

From the above discussion, it will be appreciated that the present invention provides an apparatus for promoting the separation of phases within two-phase flow in wells. The apparatus may include a baffle placed in the gap formed between the interior surface of the well casing and the exterior surface of the water or liquid extraction conduit in order to preferentially permit the flow of a higher fraction of gas volume and a lower fraction of the liquid volume therethrough. The baffle may mitigate well bore pressure fluctuations, thus reducing the occurrence of pump gas locking and reducing well bore damage.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. An apparatus for promoting the flow of methane gas from a underground coal seam aquifer to the earth's surface, the apparatus comprising:

a well casing extending into the earth with an inlet positioned proximate a coal seam aquifer and an outlet positioned proximate the surface of the earth;

a conduit extending within the well casing and having an intake positioned proximate the coal seam aquifer and an exit positioned proximate the surface of the earth;

a pump operably connected to pump water from the coal seam aquifer through the conduit to the surface; and a baffle placed in a two-phase flow to preferentially permit passage of a comparatively higher fraction of a flow of gas and a comparatively lesser fraction of a flow of water therethrough, the baffle positioned to occupy, at a location between the inlet and the outlet, at least a portion of the gap formed between the interior surface of the well casing and the exterior surface of the conduit; and the baffle further comprising a first plate having a plurality of apertures formed therethrough and distributed thereacross, a second plate, spaced from the first plate, having an eccentrically located aperture grouping formed therethrough, and a third plate, spaced from the second plate, having an eccentrically located aperture grouping formed therethrough.

2. The apparatus of claim 1, wherein the baffle distinguishes the flow of gas and the flow of water based on the respective viscosities of gas and water.

3. The apparatus of claim 1, wherein the baffle distinguishes the flow of gas and the flow of water based on the respective densities of gas and water.

4. The apparatus of claim 1, wherein the baffle distinguishes the flow of gas and the flow of water based on the respective inertia of gas and water.

5. The apparatus of claim 1, wherein the baffle distinguishes the flow of gas and the flow of water based on the respective viscosities, densities, and inertia of gas and water.

6. The apparatus of claim 1, wherein the first plate comprises an engagement aperture sized to receive the conduit therethrough.

7. The apparatus of claim 6, wherein the baffle maintains at least a selected length of the conduit substantially centered within the well casing.

8. The apparatus of claim 7 wherein the engagement aperture and the conduit have corresponding threads to provide mutual engagement.

9. The apparatus of claim 8, wherein the first plate is sized and positioned to extend from the exterior of the conduit to terminate proximate the interior surface of the well casing.

10. The apparatus of claim 1, wherein the second plate is sized and positioned to extend from the exterior of the conduit to terminate proximate the interior surface of the well casing.

11. The apparatus of claim 1, wherein the third plate is sized and positioned to extend from the exterior of the conduit to terminate proximate the interior surface of the well casing.

12. The apparatus of claim 1, wherein the first plate and the third plate are positioned on opposite sides of the second plate.

13. The apparatus of claim 12, wherein the eccentrically located aperture grouping of the second plate is not aligned with the eccentrically located aperture grouping of the third plate.

14. The apparatus of claim 13, wherein the eccentrically located aperture grouping of the second plate comprises at least one aperture.

15. The apparatus of claim 14, wherein the eccentrically located aperture grouping of the third plate comprises at least one aperture.

16. The apparatus of claim 1, wherein the baffle maintains at least a selected length of the conduit substantially centered within the well casing.

17. The apparatus of claim 1, wherein the first plate is sized and positioned to extend from the exterior of the conduit to terminate proximate the interior surface of the well casing.

18. The apparatus of claim 17, wherein the second plate is sized and positioned to extend from the exterior of the conduit to terminate proximate the interior surface of the well casing.

19. The apparatus of claim 1, wherein the eccentrically located aperture grouping of the second plate comprises at least one aperture.

20. The apparatus of claim 1, wherein the eccentrically located aperture grouping of the second plate is not aligned with the eccentrically located aperture grouping of the third plate.

21. The apparatus of claim 18, wherein the third plate is sized and positioned to extend from the exterior of the conduit to terminate proximate the interior surface of the well casing.

22. The apparatus of claim 1, wherein the eccentrically located aperture grouping of the third plate comprises at least one aperture.

23. The apparatus of claim 1, wherein the baffle imposes a tortuous path on fluids passing therethrough.

24. The apparatus of claim 22, wherein the tortuous path causes a smaller pressure drop for gas passing therethrough than for water passing therethrough.

25. The apparatus of claim 1, wherein the baffle induces a vortex flow pattern on fluids passing therethrough.

26. An apparatus defining longitudinal, lateral, and transverse directions substantially orthogonal to one another for limiting the flow of liquids through a conduit, the apparatus comprising:

a first conduit extending in the longitudinal direction from an inlet to an outlet, the first conduit having an interior surface; and a baffle assembly placed within the first conduit, the baffle comprising a first plate having a plurality of apertures formed therethrough and distributed thereacross, the first plate extending in the lateral and transverse directions to terminate proximate the interior surface of the first conduit, a second plate, spaced in the longitudinal direction from the first plate, having an eccentrically located aperture grouping formed therethrough, the second plate extending in the lateral and transverse directions to terminate proximate the interior surface of the first conduit, and a third plate, spaced in the longitudinal direction from the second plate, having an eccentrically located aperture grouping formed therethrough.

27. The apparatus of claim 26, wherein the third plate extends in the lateral and transverse directions to terminate proximate the interior surface of the first conduit.

28. The apparatus of claim 26, wherein the eccentrically located aperture grouping of the second plate is not aligned in the longitudinal direction with the eccentrically located aperture grouping of the third plate.

29. The apparatus of claim 26, wherein the eccentrically located aperture grouping of the second plate comprises at least one aperture.

30. The apparatus of claim 26, wherein the eccentrically located aperture grouping of the third plate comprises at least one aperture.

31. The apparatus of claim 26, further comprising a second conduit sized to fit within the first conduit and extend in the longitudinal direction from an intake to an exit.

32. The apparatus of claim 31, wherein the first plate has an engagement aperture sized to receive the second conduit therethrough.

33. The apparatus of claim 32, wherein the second plate has an engagement aperture sized to receive the second conduit therethrough.

34. A method for limiting the occurrence of gas lock in pumps used to lift water from coal bed methane wells, the method comprising:

providing a well comprising a cavity formed within a coal seam aquifer and well casing extending from the cavity to the surface;

providing a water extraction conduit sized to fit within the well casing;

providing a baffle having an engagement aperture sized to receive the water extraction conduit and an outer diameter providing a selected clearance within the well casing;

securing the baffle to the water extraction conduit at a selected location therealong;

providing a pump;

operably connecting the pump to the water extraction conduit; and lowering the water extraction conduit, with the pump and baffle secured thereto, into the well casing until the pump rests in the cavity and the baffle is positioned to resist the flow of water in the gas between the water extraction conduit and the casing conduit.

35. A method for repairing a coal bed methane pumping system, the method comprising:

locating a coal bed methane well having a first, failed pump suspended on a first water extraction conduit in a well casing;

pulling the first water extraction conduit and first, failed pump from the well casing;

providing the baffle sized to surround a second water extraction conduit and fit within the well casing;

securing the baffle to the second water extraction conduit at a selected location therealong;

operably connecting a second pump to the second water extraction conduit;

lowering the second water extraction conduit, with the second pump and the baffle secured thereto, into the well casing to a desired depth.

36. The method of claim 35, wherein the baffle comprises a first plate having a plurality of apertures formed therethrough and distributed thereacross, the first plate surrounding the second water extraction conduit and there extending therefrom in the lateral and transverse directions to terminate proximate the interior surface of the well casing when inserted therein.

* * * * *